US009421782B2

(12) United States Patent
Okuno

(10) Patent No.: US 9,421,782 B2
(45) Date of Patent: Aug. 23, 2016

(54) LIQUID CONTAINING BODY, ELECTRIC CONNECTION BODY, AND LIQUID CONSUMING APPARATUS

(71) Applicant: SEIKO EPSON CORPORATION, Tokyo (JP)

(72) Inventor: Tokujiro Okuno, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/844,547

(22) Filed: Sep. 3, 2015

(65) Prior Publication Data

US 2016/0067979 A1 Mar. 10, 2016

(30) Foreign Application Priority Data

Sep. 5, 2014 (JP) ..... 2014-181176

(51) Int. Cl.
*B41J 2/175* (2006.01)

(52) U.S. Cl.
CPC ..... *B41J 2/17526* (2013.01); *B41J 2/17513* (2013.01); *B41J 2/17523* (2013.01); *B41J 2/17553* (2013.01)

(58) Field of Classification Search
CPC .. B41J 2/1752; B41J 2/17513; B41J 2/17523; B41J 2/17526; B41J 2/17533; B41J 2/17546; B41J 2002/17516; B41J 2/17586
USPC ..... 347/49, 50, 85, 86, 87
See application file for complete search history.

(56) References Cited

U.S. PATENT DOCUMENTS

| | | | | |
|---|---|---|---|---|
| 6,318,850 | B1 * | 11/2001 | Childers | B41J 2/17506 347/85 |
| 7,080,898 | B2 * | 7/2006 | Katayama | B41J 2/17523 347/85 |
| 7,097,294 | B2 * | 8/2006 | Ishizawa | B41J 2/17506 347/100 |
| 7,959,268 | B2 * | 6/2011 | Osawa | B41J 2/175 347/84 |
| 9,033,475 | B2 * | 5/2015 | Urabe | B41J 2/17556 347/5 |
| 9,114,623 | B2 * | 8/2015 | Kawajiri | B41J 2/17546 |
| 2014/0253643 | A1 | 9/2014 | Yoda et al. | |

FOREIGN PATENT DOCUMENTS

| | | | |
|---|---|---|---|
| CN | 203726993 | U | 7/2014 |
| EP | 3006213 | A1 | 4/2016 |
| WO | 97/42035 | A1 | 11/1997 |

* cited by examiner

*Primary Examiner* — Anh T. N. Vo
(74) *Attorney, Agent, or Firm* — Stroock & Stroock & Lavan LLP

(57) ABSTRACT

Simplification of a connecting operation for liquid supply between a liquid consuming apparatus and a liquid containing body at least a part of which is flexible is achieved. A printer 10 has a liquid supply apparatus 20 on a right side wall 106 . The liquid supply apparatus 20 has an attachment/detachment unit 30 in an inclined manner such that a K1-axis direction in which a liquid introduction portion 362 thereof extends for liquid introduction forms an angle a1 that is larger than 0 degree and smaller than 90 degrees in a clockwise direction with respect to the right side wall 106 when the printer 10 is viewed from vertically above. A liquid containing body 50 has an operation member 53 on an upper end side of a flexible liquid containing portion 52, and a liquid supply portion 57 capable of being connected to the liquid introduction portion 362 of the attachment/detachment unit 30 in the K1-axis direction is connected to the operation member 53.

8 Claims, 28 Drawing Sheets

CROSS-SECTIONAL VIEW
TAKEN ALONG LINE F13-F13

AS VIEWED ALONG ARROW F17B

PARTIAL CROSS-SECTIONAL VIEW
TAKEN ALONG LINE F20-F20

LIQUID CONTAINING BODY, ELECTRIC CONNECTION BODY, AND LIQUID CONSUMING APPARATUS

BACKGROUND

1. Technical Field

The present invention relates to liquid containing bodies, electric connection bodies, and liquid consuming apparatuses.

2. Related Art

As a liquid containing body capable of supplying liquid to a liquid consuming apparatus, a mode of supplying ink to a printer, which is an exemplary liquid consuming apparatus, has been known hitherto. As a kind of this mode, it has been proposed to contain ink in a flexible containing bag, house the containing bag in a case provided on a printer side face, and supply, via a tube, the ink to a cartridge equipped with a head provided on a carriage (e.g., WO97/42035).

With the supply method proposed in WO97/42035, when the ink is mostly consumed and needs to be replaced, it is necessary to replace the containing bag and connect the tube to a supply port of the replaced containing bag. Since a connecting end of the tube is a free end, and the containing bag is flexible, it has been indicated that the connection of the tube to the containing bag is difficult. Also, a large-volume ink capacity has been demanded in recent years, and therefore the volume of the ink containing bag has also been becoming large. Accordingly, deformation of the containing bag due to the weight of the ink itself has also been likely to occur, and trouble has tended to occur in a tube connecting operation performed on the side of the containing bag. The same applies to electric connection.

SUMMARY

The invention deals with at least a part of the foregoing problem, and an advantage of some aspect of the invention is to achieve simplification of a connecting operation for liquid supply between a liquid consuming apparatus and a liquid containing body at least a part of which is flexible.

The invention has been made in order to solve at least a part of the foregoing problem, and can be achieved in the following modes.

(1) According to a mode of the invention, a liquid containing body is provided. This liquid containing body is a liquid containing body to be connected to a liquid consuming apparatus having a liquid introduction portion. The liquid consuming apparatus has a right side wall constituting a first side face with respect to a front face of the apparatus, and a left side wall constituting a second side face with respect to the front face. When the liquid consuming apparatus has the liquid introduction portion on the right side wall, an angle a1 is set larger than 0 degree and smaller than 90 degrees, the angle a1 being formed, in a plan view of the liquid consuming apparatus as viewed from vertically above, in a clockwise direction with respect to the right side wall by an introduction portion extending direction that is a direction in which the liquid introduction portion extends for liquid introduction. When the liquid consuming apparatus has the liquid introduction portion on the left side wall, an angle a2 is set larger than 0 degree and smaller than 90 degrees, the angle a2 being formed, in the plan view, in a counterclockwise direction with respect to the left side wall by the introduction portion extending direction. The liquid containing body includes: a liquid containing portion at least a part of which is flexible; an operation portion that is located at an upper part of the liquid containing body when the liquid containing body is connected to the liquid consuming apparatus, and can be held; and a liquid supply portion that is connected to the operation portion, can be connected to the liquid introduction portion in the introduction portion extending direction, and guides liquid contained in the liquid containing portion from the liquid containing portion to the connected liquid introduction portion.

In the liquid containing body in this mode, the operation portion located at the upper part of the liquid containing portion is held, and until the liquid containing body is connected to the liquid introduction portion of the liquid consuming apparatus in this state, a first operation of bringing, along a roughly linear trajectory, the operation portion close to the liquid introduction portion from the front side of the liquid consuming apparatus until the operation portion faces the liquid introduction portion, and a second operation of bringing, along a roughly linear trajectory, the operation portion close to the liquid introduction portion such that the liquid supply portion is connected to the liquid introduction portion in the introduction portion extending direction are necessary. In the case of a liquid consuming apparatus that has the liquid introduction portion on the right side wall, the introduction portion extending direction of the liquid introduction portion is the direction at the angle a1 that is larger than 0 degree and smaller than 90 degrees in the clockwise direction with respect to the right side wall in a plan view of the liquid consuming apparatus as viewed from vertically above. Therefore, the operation along the linear trajectory conforming to the second operation need only be performed after the first operation while keeping the posture of holding the operation portion at the time of performing the aforementioned first operation. Accordingly, since the first operation and the second operation can be executed as a series of operations without changing the holding posture of holding the operation portion, the operation of attaching the liquid containing body is facilitated. In the case of a liquid consuming apparatus that has the liquid introduction portion on the left side wall, the introduction portion extending direction of the liquid introduction portion is the direction at the angle a2 that is larger than 0 degree and smaller than 90 degrees in the counterclockwise direction with respect to the left side wall in the plan view. Therefore, as in the above-described case, the first operation and the second operation can be executed as a series of operations without changing the holding posture of holding the operation portion, and accordingly the operation of attaching the liquid containing body is facilitated.

In particular, in the case of a liquid consuming apparatus that has a plurality of liquid introduction portions arranged from the apparatus front side toward the apparatus back side on the right side wall or the left side wall, the invention has the following advantages. When connecting the liquid supply portion of the liquid containing body to the liquid introduction portion on the apparatus back side, other liquid introduction portions and the liquid containing bodies that are already connected to these liquid introduction portions exist further on the apparatus front side than the liquid introduction portion on the apparatus back side. However, the aforementioned series of operations at the time of connecting the liquid supply portion of the liquid containing body to the liquid introduction portion on the apparatus back side can be started from the apparatus front side where the operations do not interfere with the other liquid introduction portions on the apparatus front side and the liquid containing bodies already connected thereto. Therefore, it is not necessary to move the liquid containing body while unnecessarily detouring the liquid containing body along a long trajectory, which is convenient.

A space for the operation of connecting the liquid containing body can also be reduced. Note that it is desirable that the aforementioned angles a1 and a2 formed by the introduction portion extending direction of the liquid introduction portion are in the range from 45 to 70 degrees.

(2) In the liquid containing body in the above mode, the liquid consuming apparatus may have an electric connection portion that is arranged side-by-side with the liquid introduction portion in a horizontal direction in a front view of the liquid introduction portion as viewed in the introduction portion extending direction, and the liquid containing body may further include a contact portion capable of coming into contact with the electric connection portion, the contact portion being arranged in the operation portion side-by-side with the liquid supply portion in association with arrangement of the liquid introduction portion and the electric connection portion. With this configuration, the contact portion of the operation portion can also be connected to the electric connection portion of the liquid consuming apparatus by the aforementioned series of operations until the liquid containing body is connected to the liquid introduction portion of the liquid consuming apparatus in a state where the operation portion located at the upper part of the liquid containing portion is held.

(3) According to another mode of the invention, an electric connection body is provided. This electric connection body is an electric connection body having a contact portion capable of coming into contact with an electric connection portion of a liquid consuming apparatus. In the electric connection portion of the liquid consuming apparatus, a plurality of apparatus-side terminals capable of coming into contact with the contact portion of the electric connection body are arranged side-by-side in a horizontal direction. The liquid consuming apparatus has a right side wall constituting a first side face with respect to a front face of the apparatus, and a left side wall constituting a second side face with respect to the front face. When the liquid consuming apparatus has the electric connection portion on the right side wall, an angle a1 is set larger than 0 degree and smaller than 90 degrees, the angle a1 being formed, in a plan view of the liquid consuming apparatus as viewed from vertically above, in a clockwise direction with respect to the right side wall by a direction orthogonal to a horizontal arranging direction of the apparatus-side terminals. When the liquid consuming apparatus has the electric connection portion on the left side wall, an angle a2 is set larger than 0 degree and smaller than 90 degrees, the angle a2 being formed, in the plan view, in a counterclockwise direction with respect to the left side wall by the direction orthogonal to the horizontal arranging direction of the apparatus-side terminals. The electric connection body includes: an operation portion that can be held when the electric connection body is connected to the liquid consuming apparatus; and a plurality of the contact portions that are provided in the operation portion and can come into contact with the apparatus-side terminals of the electric connection portion. With the electric connection body in this mode, as with the above liquid containing body, a first operation of bringing, along a roughly linear trajectory, the operation portion close to the electric connection portion from the front side of the liquid consuming apparatus until the operation portion faces the electric connection portion, and a second operation of bringing, along a roughly linear trajectory, the operation portion close to the liquid introduction portion such that the contact portion is connected to the electric connection portion can be executed as a series of operations without changing the holding posture of holding the operation portion. Accordingly, the operation of attaching the electric connection body is facilitated. The same effect can also be achieved in the case of providing a plurality of electric connection portions from the apparatus front side toward the apparatus back side on the right side wall or the left side wall.

(4) According to still another mode of the invention, a liquid consuming apparatus is provided. This liquid consuming apparatus is a liquid consuming apparatus to which a liquid containing body containing liquid is to be connected. The liquid consuming apparatus includes: a right side wall constituting a first side face with respect to a front face of the apparatus; and a left side wall constituting a second side face with respect to the front face. When the liquid consuming apparatus has, on the right side wall, a liquid introduction portion to which the liquid containing body is to be connected, an angle a1 is set larger than 0 degree and smaller than 90 degrees, the angle a1 being formed, in a plan view of the liquid consuming apparatus as viewed from vertically above, in a clockwise direction with respect to the right side wall by an introduction portion extending direction that is a direction in which the liquid introduction portion extends for liquid introduction. When the liquid consuming apparatus has the liquid introduction portion on the left side wall, an angle a2 is set larger than 0 degree and smaller than 90 degrees, the angle a2 being formed, in the plan view, in a counterclockwise direction with respect to the left side wall by the introduction portion extending direction. The liquid containing body includes: a liquid containing portion at least a part of which is flexible; an operation portion that is located at an upper part of the liquid containing body when the liquid containing body is connected to the liquid consuming apparatus, and can be held; and a liquid supply portion that is connected to the operation portion, can be connected to the liquid introduction portion in the introduction portion extending direction, and guides liquid contained in the liquid containing portion from the liquid containing portion to the connected liquid introduction portion. With the liquid consuming apparatus in this mode, as with the liquid consuming apparatus in the above mode to which the liquid containing body is to be connected, a first operation of bringing, along a roughly linear trajectory, the operation portion close to the liquid introduction portion from the front side of the liquid consuming apparatus until the operation portion faces the liquid introduction portion, and a second operation of bringing, along a roughly linear trajectory, the operation portion close to the liquid introduction portion such that the liquid supply portion is connected to the liquid introduction portion in the introduction portion extending direction can be executed as a series of operations without changing the holding posture of holding the operation portion. Accordingly, the operation of attaching the liquid containing body is facilitated. The same effect can also be achieved in the case of providing a plurality of electric connection portions from the apparatus front side toward the apparatus back side on the right side wall or the left side wall.

(5) The liquid consuming apparatus in the above mode may further include an electric connection portion that is arranged side-by-side with the liquid introduction portion in a horizontal direction in a front view of the liquid introduction portion as viewed in the introduction portion extending direction. The liquid containing body may have a contact portion capable of coming into contact with the electric connection portion, the contact portion being arranged in the operation portion side-by-side with the liquid supply portion in association with arrangement of the liquid introduction portion and the electric connection portion. With this configuration, the contact portion of the operation portion can also be connected to the electric connection portion of the liquid consuming apparatus by the aforementioned series of operations until the liquid containing body is connected to the liquid introduction portion of the liquid consuming apparatus in a state where the operation portion located at the upper part of the liquid containing portion is held.

Not all of a plurality of constituent components provided in the above-described modes of the invention are essential, and some of the plurality of constituent components may be modified, deleted, or replaced with a new constituent component, or the content of limitation may be partially deleted as appropriate, in order to solve a part of or the entire problem described above, or to achieve some or all of the effects described in this specification. It is also possible to combine some or all of the technical features included in one of the above-described modes of the invention with some or all of the technical features included in the other of the above-described modes of the invention to make an independent mode of the invention, in order to solve a part of or the entire problem described above, or to achieve some or all of the effects described in the specification.

The invention can be achieved in various modes, and for example, the invention can be achieved in modes such as a liquid supply system in which liquid is supplied from a liquid containing body to a liquid consuming apparatus, a system including a liquid containing body and a liquid consuming apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, embodiments of the invention will be described in the following order.

A and B. First and Second Embodiments

C. Various modifications

A. First Embodiment

A-1. Configuration of Liquid Consuming System

Figure 1:
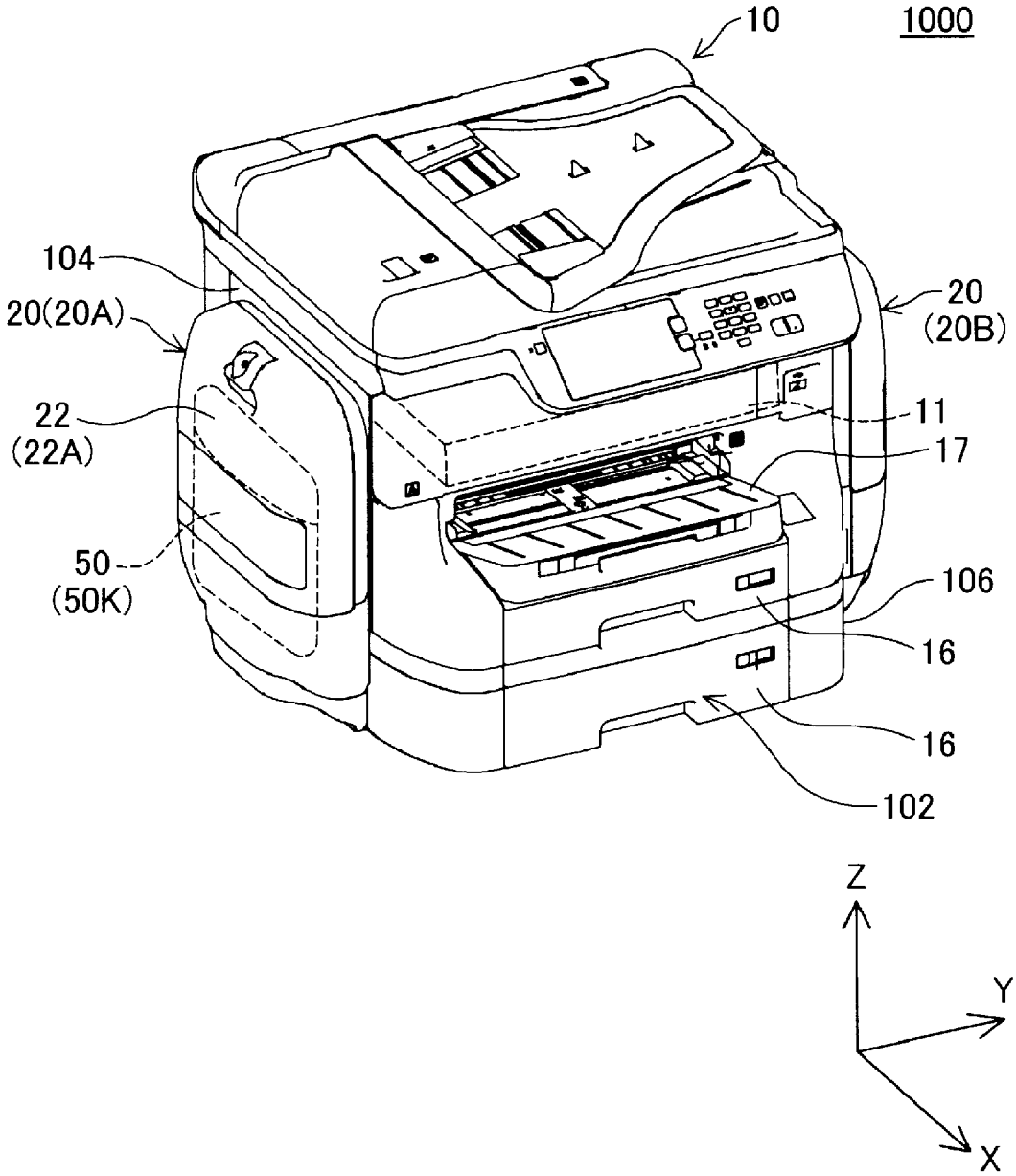
FIG. 1 is a first perspective view showing an outline configuration of a liquid consuming system 1000 in a first embodiment.
Figure 2:
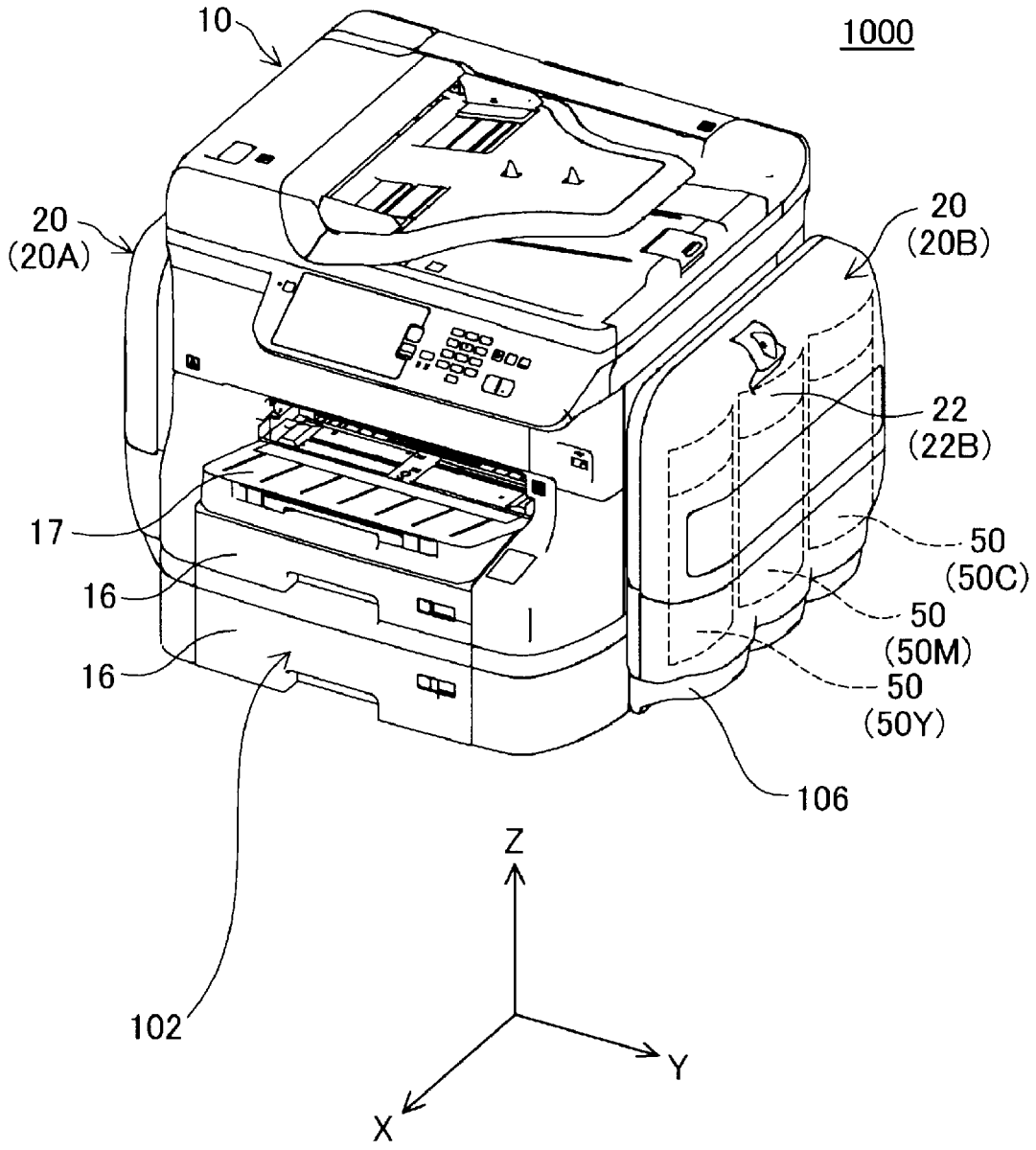
FIG. 2 is a second perspective view showing an outline configuration of the liquid consuming system 1000.
Figure 3:
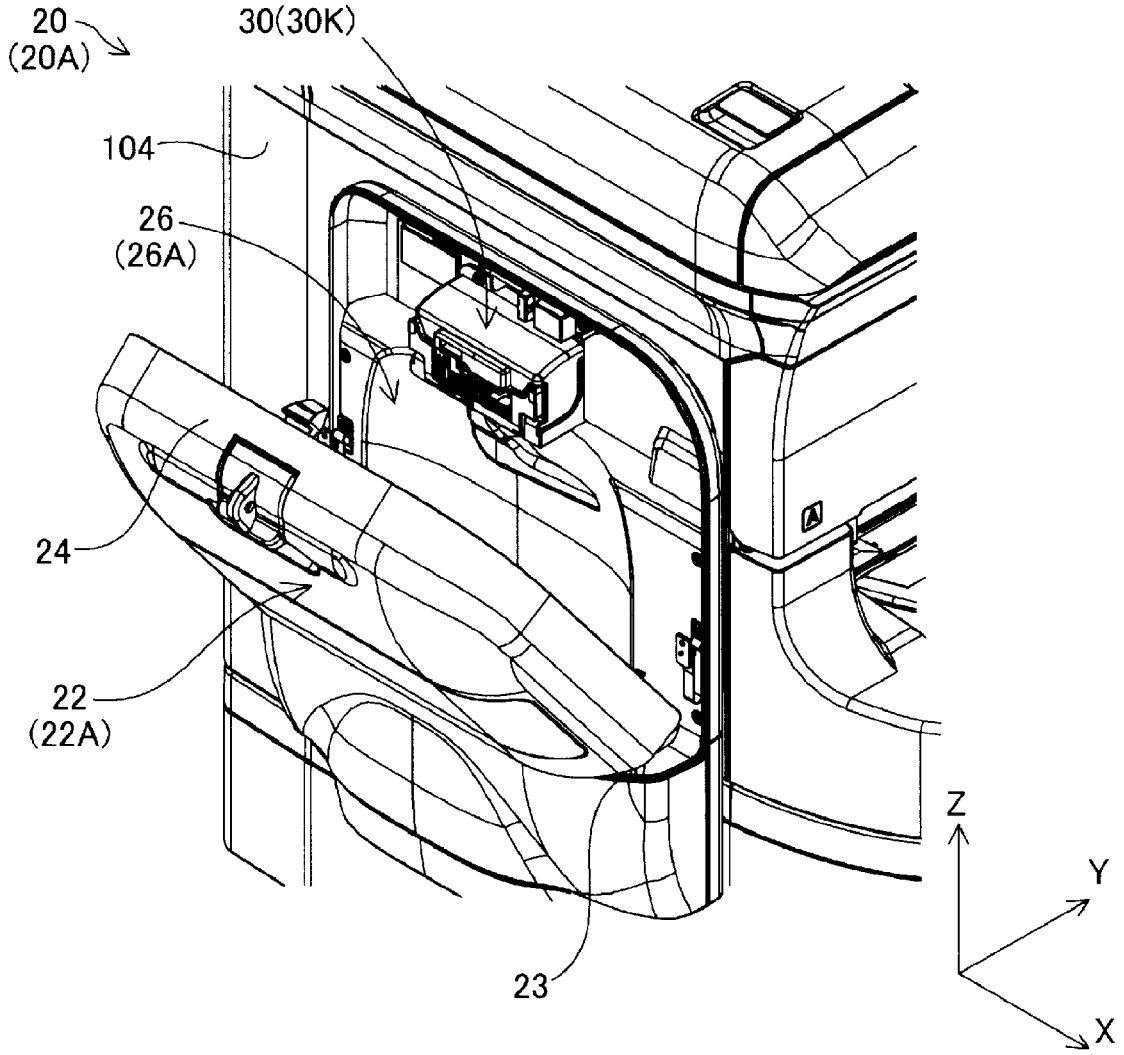
FIG. 3 is a first view for illustrating a liquid supply apparatus 20.
Figure 4:
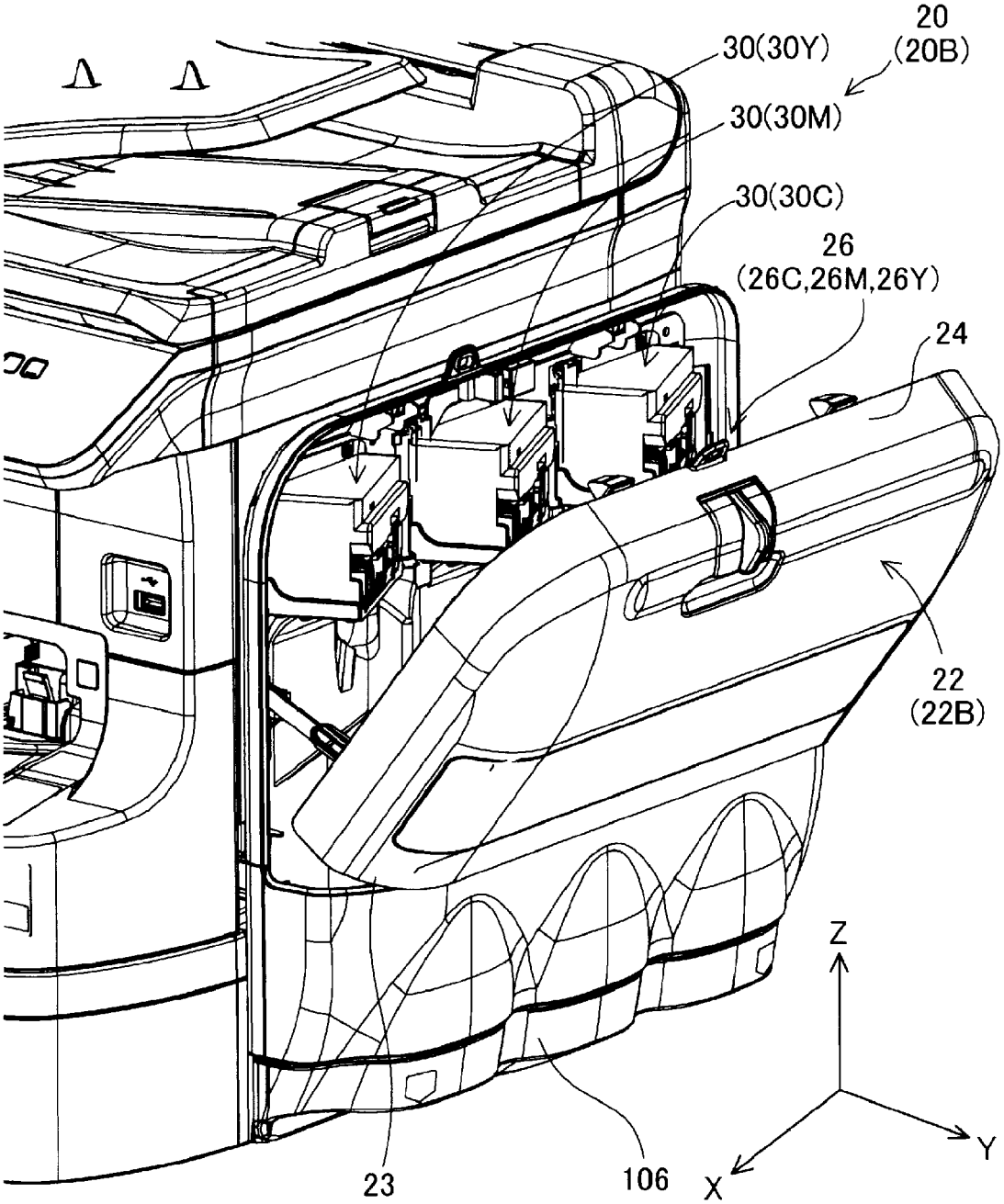
FIG. 4 is a second view for illustrating the liquid supply apparatus 20.

FIG. 1 is a first perspective view showing an outline configuration of a liquid consuming system 1000 in a first embodiment. FIG. 2 is a second perspective view showing an outline configuration of the liquid consuming system 1000. FIG. 3 is a first view for illustrating a liquid supply apparatus 20. FIG. 4 is a second view for illustrating the liquid supply apparatus 20. Note that FIGS. 3 and 4 each show a state where a later-described liquid containing body is removed. In FIGS. 1 to 4, XYZ axes orthogonal to one another are indicated.

As shown in FIG. 1, the liquid consuming system 1000 includes a printer 10 serving as a liquid consuming apparatus, and two liquid supply apparatuses 20. When the liquid consuming system 1000 is used, the printer 10 is installed on a horizontal surface defined by an X-axis direction and a Y-axis direction. That is to say, a Z-axis direction is the vertical direction (up-down direction). A −Z-axis direction is a vertically downward direction, and a +Z-axis direction is a vertically upward direction. The liquid supply apparatus 20 constitutes a liquid supply system that supplies ink, which serves as liquid, to the printer 10. Liquid containing bodies 50 included in the liquid supply apparatus 20 can be connected (attached) to the printer 10 in a detachable manner.

The printer 10 is an inkjet printer. The printer 10 includes a recording mechanism 11, paper feed trays 16, and a discharge tray 17. A plurality of paper feed trays 16 are provided at different height positions in the vertical direction. The paper feed trays 16 are provided in an apparatus first face (apparatus front face) 102 of the printer 10. Recording media (e.g., paper) on which an image such as a character is printed (recorded) by the printer 10 are contained in the paper feed trays 16.

The recording mechanism 11 includes a recording head (not shown) that discharges ink. The recording head is in communication with the liquid supply apparatus 20 via a flow tube. The recording head performs recording (printing) by discharging ink onto the recording media, using the ink supplied from the liquid supply apparatus 20. The recording media onto which the recording has been performed is discharged to the discharge tray 17.

The two liquid supply apparatuses 20 are provided respectively in an apparatus second face (also called an apparatus second side face, an apparatus second side wall, or a left side wall) 104 and an apparatus third face (also called as an apparatus first side face, an apparatus first side wall, or a right side wall) 106 that intersect the apparatus first face (also called an apparatus front face or an apparatus front wall) 102 of the printer 10. The apparatus first face 102 to the apparatus third face 106 are faces that are substantially vertical to the installation surface when the printer 10 is used. The apparatus second face 104 is opposed to the apparatus third face 106. Here, the liquid supply apparatus 20 provided in the apparatus second face 104 will also be called a first liquid supply apparatus 20A, and the liquid supply apparatus 20 provided in the apparatus third face 106 will also be called a second liquid supply apparatus 20B. Note that the two liquid supply apparatuses 20 will be simply called the liquid supply apparatuses 20 when not distinguishing between the first and second liquid supply apparatuses 20A and 20B.

As shown in FIG. 1, the first liquid supply apparatus 20A includes a cover member 22, a liquid containing body 50, and an attachment/detachment unit 30 (FIG. 3). As shown in FIG. 2, the second liquid supply apparatus 20B includes a cover member 22, three liquid containing bodies 50, and three attachment/detachment units 30 (FIG. 4) corresponding to the respective liquid containing bodies 50. Here, reference numerals "22A" and "22B" will be used when distinguishing between the two cover members 22. Also, reference numerals "50K", "50C", "50M", and "50Y" will be used when distinguishing among the four liquid containing bodies 50. Reference numerals "30K", "30C", "30M", and "30Y" will be used when distinguishing among the four attachment/detachment units 30. Note that the number of cover members 22, liquid containing bodies 50, and attachment/detachment units 30 is not limited to the above. For example, the number of liquid containing bodies 50 may be three or smaller, or may be five or larger. The attachment/detachment units 30 may be provided so as to correspond to the number of liquid containing bodies 50. The number of cover members 22 may be one, or may be three or larger.

The four liquid containing bodies 50 contain (are filled with) different types of ink. In this embodiment, yellow (Y), magenta (M), cyan (C), and black (K) inks are contained in different liquid containing bodies 50. The liquid containing body 50K has a liquid containing portion containing the black ink, the liquid containing body 50C has a liquid containing portion containing the cyan ink, the liquid containing body 50M has a liquid containing portion containing the magenta ink, and the liquid containing body 50Y has a liquid containing portion containing the yellow ink. As shown in FIGS. 3 and 4, the liquid containing bodies 50 are housed in housing space portions 26 demarcated by the cover members 22. Specifically, the liquid containing body 50K is housed in a housing space portion 26A (FIG. 3) on the side of a left side wall 104 while being attached to a later-described attachment/detachment unit 30K, and the liquid containing bodies 50C, 50M, and 50Y are housed in a housing space portion 26B (FIG. 4) on the side of a right side wall 106 while being attached to later-described attachment/detachment units 30C, 30M, and 30Y, respectively.

The attachment/detachment units 30 shown in FIGS. 3 and 4 allow the liquid containing bodies 50 to be detachably attached thereto. The attachment/detachment unit 30K is arranged within the cover member 22A, and the attachment/detachment units 30C, 30M, and 30Y are arranged within the cover member 22B. As shown in FIG. 3, the attachment/detachment unit 30K is provided on the apparatus second face 104 of the printer 10. As shown in FIG. 4, the attachment/detachment units 30C, 30M, and 30Y are provided in the apparatus third face 106 of the printer 10. When each liquid containing body 50 is attached to the corresponding detachable unit 30, the ink contained in the liquid containing body 50 is supplied to the recording head of the printer 10 by a supply mechanism (not shown) having a pump function of the printer 10.

As shown in FIGS. 3 and 4, each cover member 22 is configured to be able to be opened and closed by rotating a second end portion 24 located on the side in the vertically upward direction with a first end portion 23 located on the side in the vertically downward direction as a fulcrum. After the ink contained in each liquid containing body 50 is consumed, a user opens the corresponding cover member 22 and removes the liquid containing body 50 in which the ink has been consumed, from the attachment/detachment unit 30. The user then attaches a new liquid containing body 50 to the attachment/detachment unit 30 and thereafter closes the cover member 22.

A-2. Configuration of Attachment/Detachment Unit 30

Figure 5:
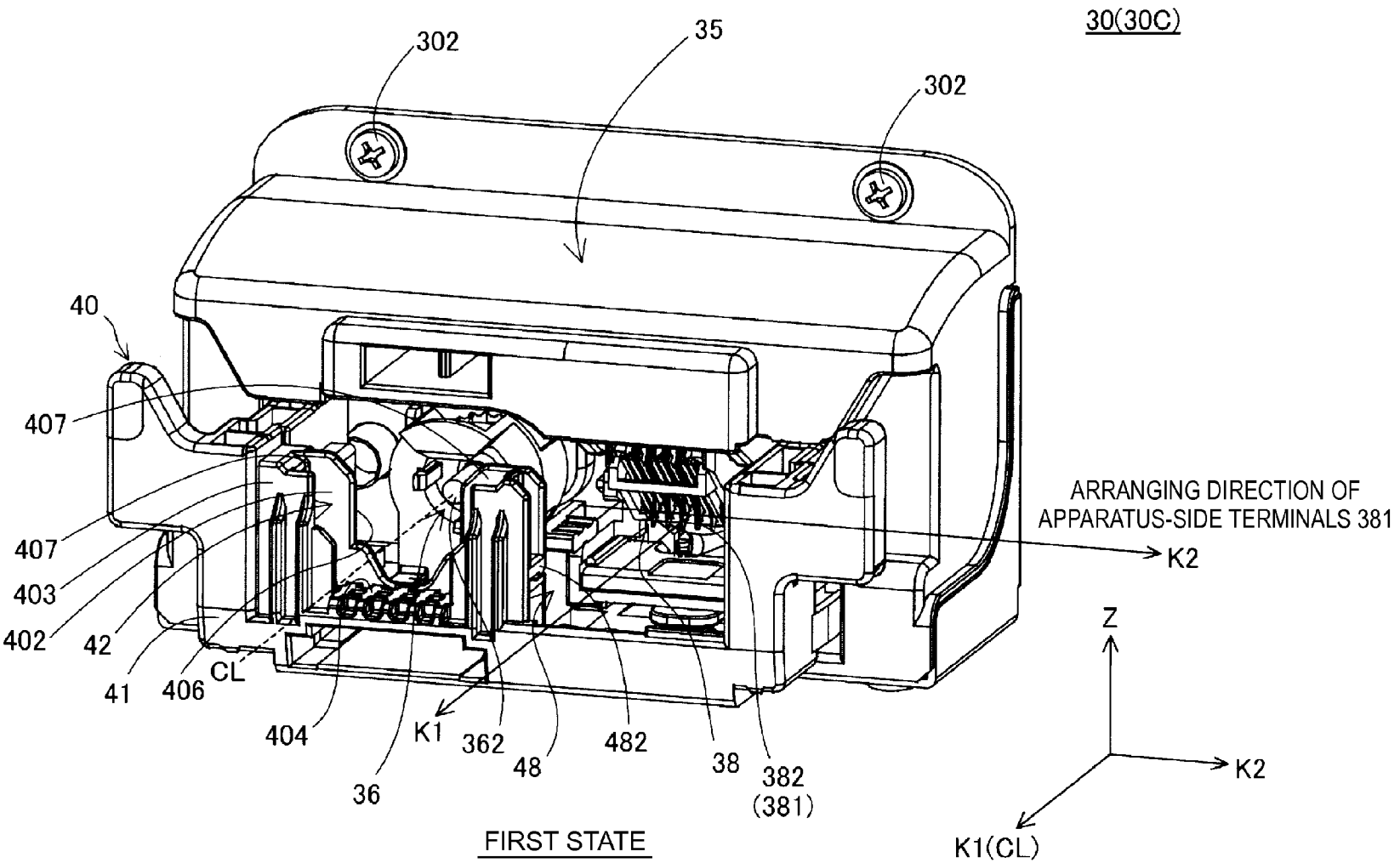
FIG. 5 is a first perspective view for illustrating an attachment/detachment unit 30.
Figure 6:
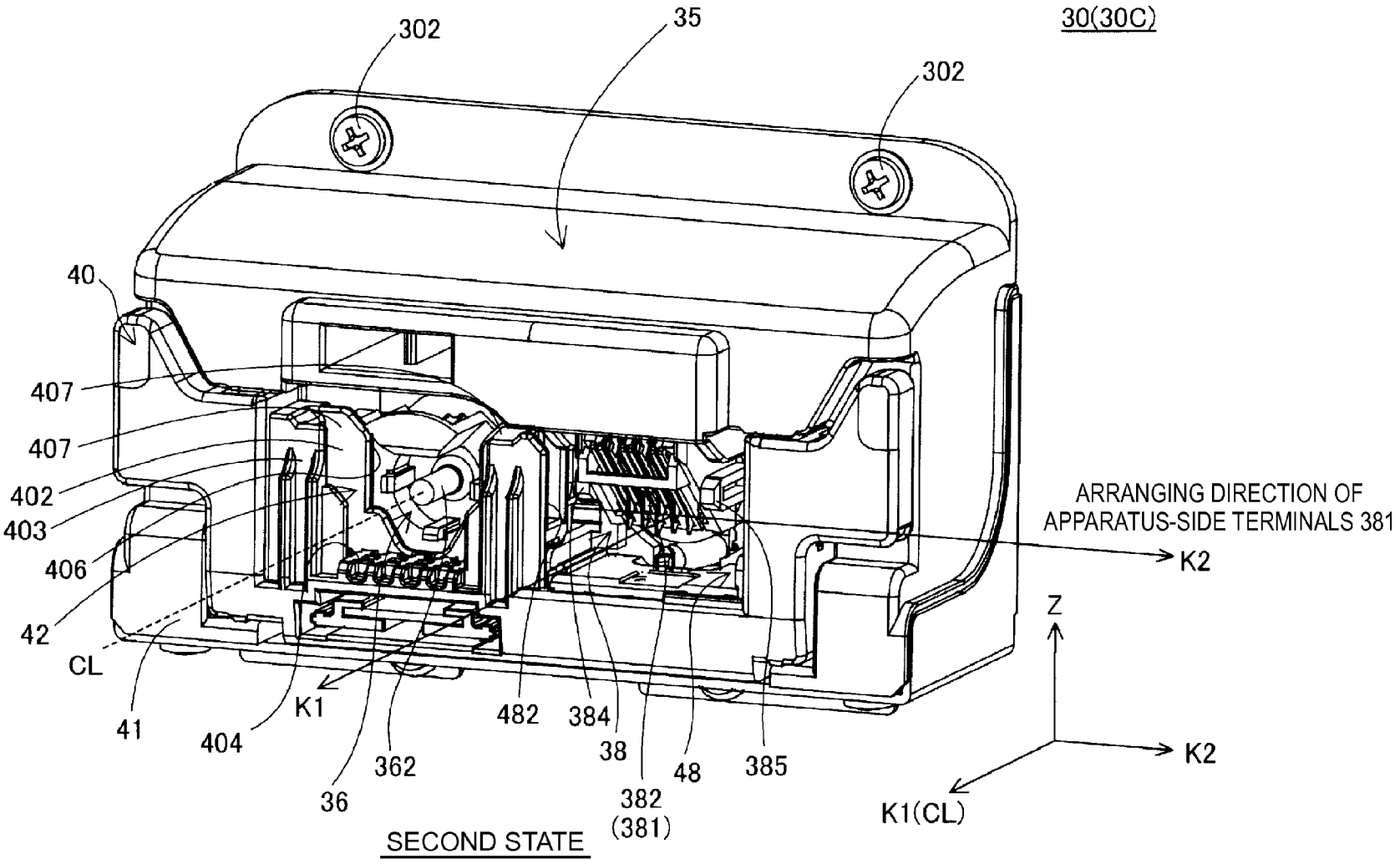
FIG. 6 is a second perspective view for illustrating the attachment/detachment unit 30.

FIG. 5 is a first perspective view for illustrating the attachment/detachment unit 30. FIG. 6 is a second perspective view for illustrating the attachment/detachment unit 30. FIG. 5 shows a first state (state at the time of setting) in which a movable member 40 projects outward of a fixed member 35. FIG. 6 shows a second state (state at the time of attachment) in which the movable member 40 is housed in the fixed member 35. Although the configuration will be described, taking the attachment/detachment unit 30C as an example in FIGS. 5 and 6, the other attachment/detachment units 30K, 30M, and 30Y also have the same configuration as the attachment/detachment unit 30C. As shown in FIG. 5, the attachment/detachment unit 30 includes the fixed member 35 and the movable member 40.

The liquid containing body 50 is detachably attached to the attachment/detachment unit 30 by executing the following two operations. The state where the liquid containing body 50 is attached to the attachment/detachment unit 30 will also be called an "attached state (connected state)". The attached state (connected state) refers to a state where a later-described liquid supply portion 57 in the liquid containing body 50 is connected to a liquid introduction portion (liquid introduction needle) 362 in the attachment/detachment unit 30, and a circuit board 582 in the liquid containing body 50 is electrically connected to an electric connection portion (apparatus-side electric connection portion) 382 in the attachment/detachment unit 30. In the attached state, the ink contained in the liquid containing body 50 is in a state of being able to flow toward the side of the printer 10.

—First Operation

The user brings the attachment/detachment unit 30 into the first state (see FIG. 5), and thereafter sets the liquid containing body 50 to the movable member 40.

—Second Operation

After the first operation, the user presses the movable member 40 toward the side of the fixed member 35 via the liquid containing body 50, and thereby brings the attachment/detachment unit 30 into the second state (see FIG. 6).

In the second state of the attachment/detachment unit 30, movement of the movable member 40 toward the side in a +K1-axis direction with respect to the fixed member 35 is restricted by a lock mechanism. Note that, in the second state, the locking by the lock mechanism is cancelled by pressing the movable member 40 against the fixed member 35 in an inward direction (−K1-axis direction). It is thereby possible to switch the state of the attachment/detachment unit 30 from the second state to the first state by moving the movable member 40 so as to project in the +K1-axis direction of the fixed member 35.

The fixed members 35 are fixed respectively to the apparatus second face 104 and the apparatus third face 106 (FIGS. 3 and 4) of the printer 10 by a plurality of screws 302, each of which serves as a fixing portion. Specifically, the attachment/detachment unit 30K (FIG. 3) is fixed to a back board (not shown) of the apparatus second face 104 by the plurality of screws 302, and the attachment/detachment units 30C, 30M, and 30Y (FIG. 4) are fixed to a back board 26BV of the apparatus third face 106 by the plurality of screws 302. These back boards are provided in the housing space portion 26A and the housing space portion 26B so as to be along the left side wall 104, which is the second face, and the right side wall 106.

Each fixed member 35 includes a liquid introduction mechanism 36 and a contact point mechanism 38. The liquid introduction mechanism 36 has a liquid introduction portion 362. A later-described liquid supply portion (specifically, a later-described liquid supply unit 55) provided in each liquid containing body 50 is connected to the liquid introduction portion 362, and as a result, the ink contained in the liquid containing body 50 is guided from the later-described liquid supply portion 57 and flows. The liquid introduction portion 362 is in communication with the recording head of the printer 10.

The liquid introduction portion 362 has a needle shape within which the ink can flow. The liquid introduction portion 362 extends along a center axis CL. A direction parallel with this center axis CL (i.e., an extending direction of the liquid introduction portion 362) is assumed to be the K1-axis direction. The K1-axis direction is orthogonal to the Z-axis direction. The direction orthogonal to the K1-axis direction and the Z-axis direction is assumed to be a K2-axis direction. A face defined by the K1-axis direction and the K2-axis direction is parallel with a face defined by the X-axis direction and the Y-axis direction shown in FIG. 1. Of the K1-axis direction, a direction extending to the outside of the printer 10 is the +K1-axis direction, and a direction extending to the inside of the printer 10 is the −K1-axis direction. The attachment/detachment unit 30C, the attachment/detachment unit 30M, and the attachment/detachment unit 30Y in the housing space portion 26B shown in FIG. 4 each have the liquid introduction portion 362 such that the K1 axis along which the center axis CL of the liquid introduction portion 362 extends obliquely intersects the X axis when the printer 10 is viewed from vertically above (in the +Z-axis direction), and the K1 axis forms a prescribed angle a1 with respect to the apparatus third face 106 extending in the X-axis direction. This angle a1 will be described later. The attachment/detachment unit 30K in the housing space portion 26A shown in FIG. 3 has the liquid introduction portion 362 such that the K1 axis along which the center axis CL of the liquid introduction portion 362 extends is orthogonal to the X axis. The liquid supply portion 57 of the liquid supply unit 55 in the liquid containing body 50 can be connected to this liquid introduction portion 362 along the K1 axis along which the center axis CL thereof extends.

The liquid introduction mechanism 36 and the contact point mechanism 38 are arranged in the K2-axis direction side-by-side in the horizontal direction in a front view of the liquid introduction mechanism 36 as viewed in the +K1-axis direction. Of the K2-axis direction, a direction extending from the liquid introduction mechanism 36 toward the contact point mechanism 38 is a +K2-axis direction, and a direction extending from the contact point mechanism 38 toward the liquid introduction mechanism 36 is a −K2-axis direction. Regarding the attachment/detachment unit 30, the Z-axis direction will also be called a "height direction", the K1-axis direction will also be called a "width direction", and the K2-axis direction will also be called a "depth direction".

As shown in FIGS. 5 and 6, the contact point mechanism 38 includes an electric connection portion (apparatus-side electric connection portion) 382 having a plurality of (in this embodiment, nine) apparatus-side terminals 381, and a plurality of (in this embodiment, two) apparatus-side board positioning portions 384 and 385. The plurality of apparatus-side terminals 381 that the contact point mechanism 38 has can come into contact with a later-described plurality of liquid containing body-side terminals 581 (581A to 5811) of the containing body-side electric connection portion 58 in the liquid containing body 50, and are horizontally arranged side-by-side in the aforementioned K2-axis direction. That is to say, in the attached state of the liquid containing body 50, the apparatus-side terminals 381 of the electric connection portion 382 come into contact with (i.e., are electrically connected to) the circuit board of the liquid containing body 50. The circuit board of the liquid containing body 50 and the printer 10 can thereby communicate various kinds of information (e.g., the ink color and the date of manufacture of the liquid containing body 50) with each other. A direction orthogonal to the arrangement of the plurality of apparatus-side terminals 381 in the horizontal direction (the K2-axis direction) coincides with the already-described K1-axis direction, and forms the prescribed angle a1 with respect to the apparatus third face 106 extending in the X-axis direction. The apparatus-side terminals 381 are each formed by a metal flat spring that can undergo elastic deformation. The apparatus-side board positioning portions 384 and 385 are arranged on both sides of the electric connection portion 382 in the K2-axis direction (the direction in which the liquid introduction mechanism 36 and the contact point mechanism 38 are arranged side-by-side). The apparatus-side board positioning portions 384 and 385 perform final positioning of the circuit board of the liquid containing body 50 with respect to the electric connection portion 382 when the liquid containing body 50 is attached to the attachment/detachment unit 30. The apparatus-side board positioning portions 384 and 385 are members extending in the K1-axis direction.

The movable member 40 is configured to be able to move in the K1-axis direction with respect to the fixed member 35. The movable member 40 includes a base portion 41, a supply portion support portion 42, and a board support portion 48. The supply portion support portion 42 and the board support portion 48 are connected to the base portion 41. The supply portion support portion 42 and the board support portion 48 are members extending from the base portion 41 toward the side (upper side) in the +Z-axis direction.

The supply portion support portion 42 is a member for determining the position of the liquid containing body 50 (specifically, the liquid supply portion) with respect to the liquid introduction portion 362. When the attachment/detachment unit 30 is viewed in the K1-axis direction, the supply portion support portion 42 is provided at a position overlapping the liquid introduction portion 362. The supply portion support portion 42 is provided so as to form a shape denting in the −Z-axis direction. Groove portions 407 are formed on both sides of the supply portion support portion 42 in the K2-axis direction. As a result of later-described positioning portions of the liquid containing body 50 entering the groove portions 407, movement of the liquid supply portion provided in the liquid containing body 50 is restricted. That is to say, movement of the liquid supply portion provided in the liquid containing body 50 is restricted by a plurality of face portions (e.g., a first support face portion 402, a second support face portion 403, and a third support face portion 404) that demarcate and form the supply portion support portion 42, and the liquid containing body 50 is roughly positioned with respect to the attachment/detachment unit 30. In the supply portion support portion 42, a cutout portion 406 is formed in the first support face portion 402 located on the side of the liquid introduction portion 362. The cutout portion 406 has a dent shape opening on the side in the +Z-axis direction. When the attachment/detachment unit 30 is viewed in the K1-axis direction, the cutout portion 406 is provided at a position overlapping the liquid introduction portion 362. In the first state where the movable member 40 has been moved to the maximum in the +K1-axis direction with respect to the fixed member 35, the cutout portion 406 is located further on the side in the +K1-axis direction than the liquid introduction portion 362. As shown in FIG. 6, in the second state, the tip of the liquid introduction portion 362 is located within the cutout portion 406.

The board support portion 48 is a member for determining the position of the liquid containing body 50 (specifically, the circuit board) with respect to the contact point mechanism 38. When the attachment/detachment unit 30 is viewed in the K1-axis direction, the board support portion 48 is provided at a position overlapping the contact point mechanism 38. The board support portion 48 is provided so as to form a shape denting in the -Z-axis direction. Movement of the circuit board of the liquid containing body 50 is restricted by a plurality of face portions (e.g., a first board support face portion 482) demarcating and forming the board support portion 48.

A-3. Configuration of Liquid Containing Body 50

Figure 7:
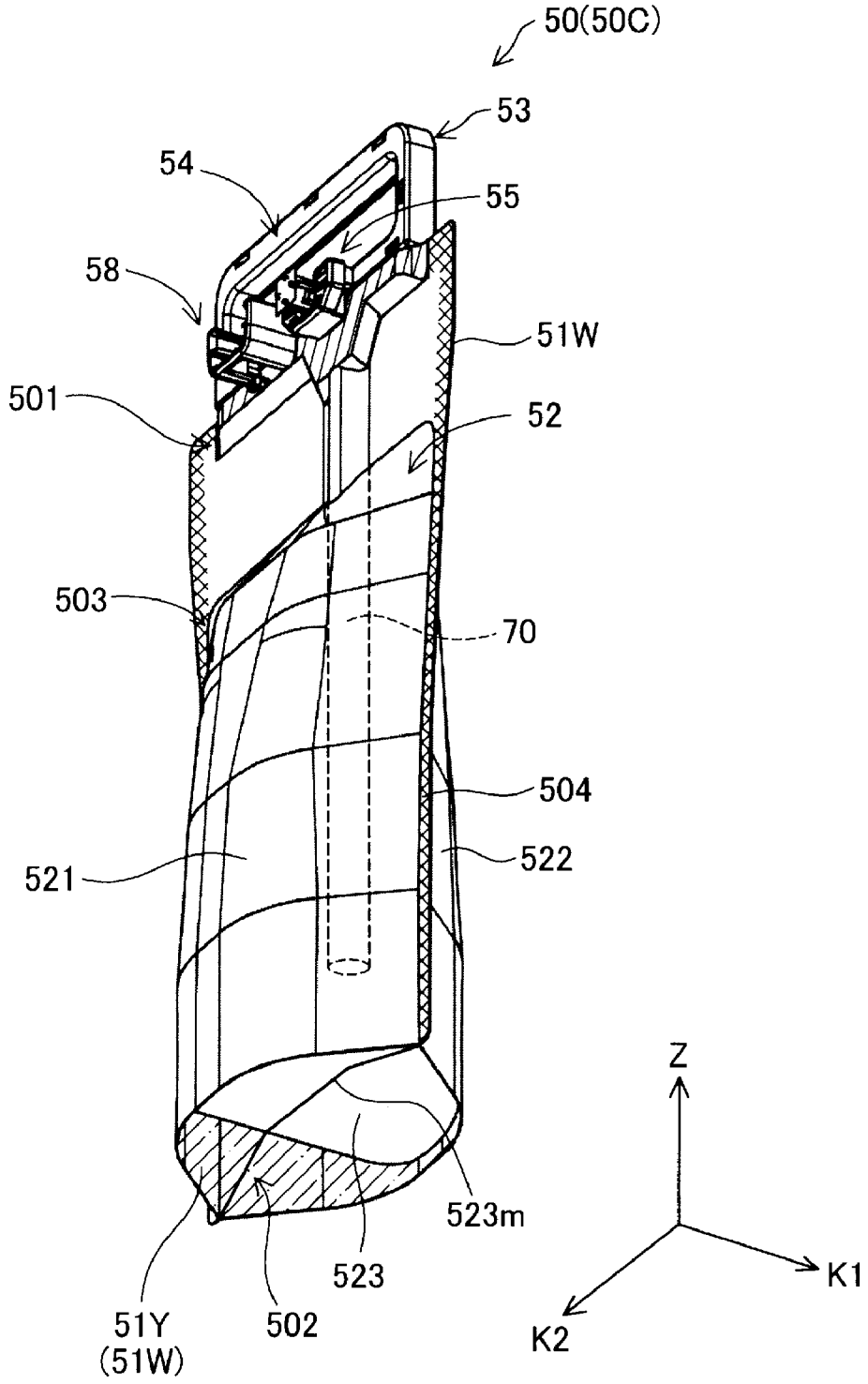
FIG. 7 is a first perspective view of a liquid containing body 50.
Figure 8:
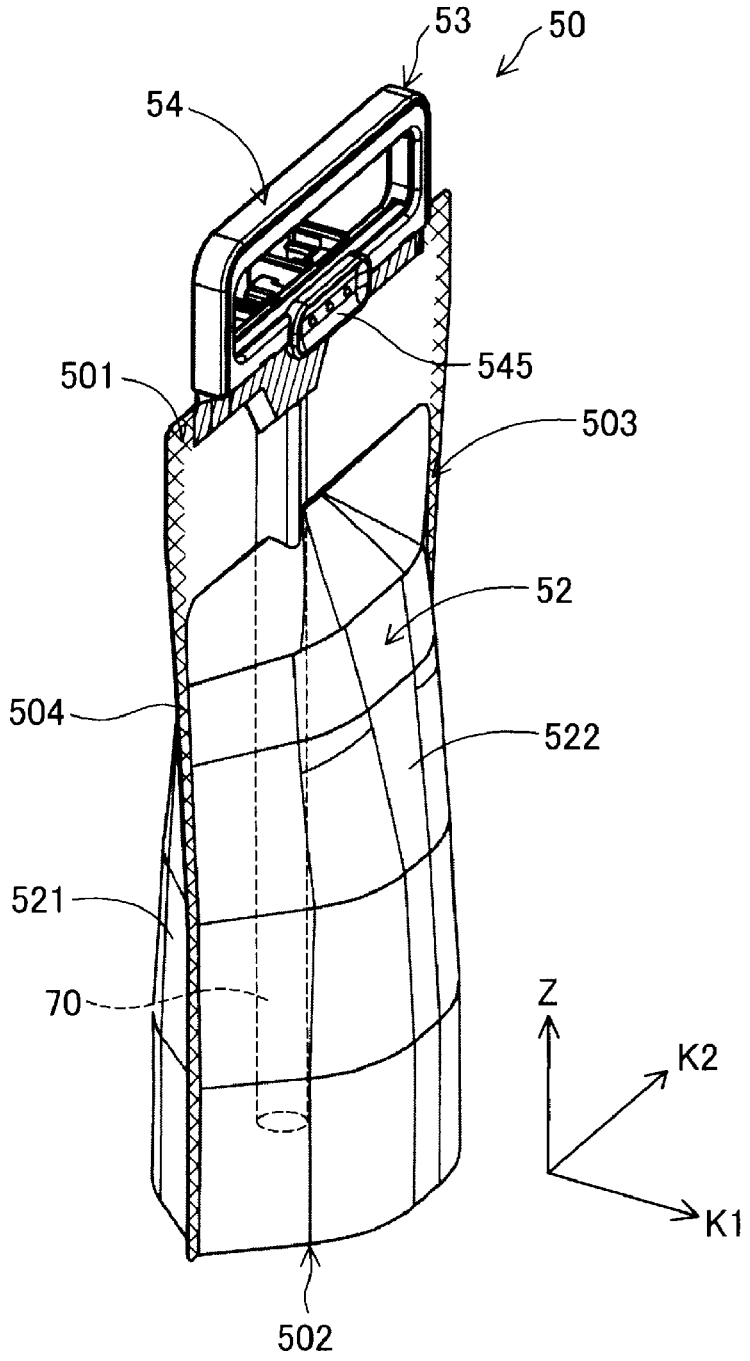
FIG. 8 is a second perspective view of the liquid containing body 50.

FIG. 7 is a first perspective view of the liquid containing body 50. FIG. 8 is a second perspective view of the liquid containing body 50. In FIGS. 7 and 8, the Z axis, the K1 axis, and the K2 axis in a state (attached state) where the liquid containing body 50 is attached to the attachment/detachment unit 30 are indicated. FIGS. 7 and 8 show the liquid containing body 50 in a state (unused state) of being filled with the ink serving as liquid before being attached to the attachment/detachment unit 30. Note that the Z axis, the K1 axis, and the K2 axis orthogonal to one another are also indicated as necessary in the later-described drawings for illustrating the liquid containing body 50. Although the configuration will be described while taking the liquid containing body 50C as an example in FIG. 7 and the subsequent drawings, the liquid containing bodies 50K, 50M, and 50Y also have the same configuration as the liquid containing body 50C.

As shown in FIG. 7, the liquid containing body 50 includes the liquid containing portion 52 and an operation member (handle portion) 53. The operation member 53 is attached while being located at one end side of the liquid containing portion 52, and is located above the liquid containing body 50 when being connected to the already-described attachment/detachment unit 30. The operation member 53 includes a holding portion (support portion) 54, a liquid supply unit 55, a board unit (containing body-side electric connection portion) 58, and a press portion 545 (FIG. 8). The holding portion 54 is a portion for a user supporting (holding) the liquid containing body 50. The liquid supply unit 55 is a portion corresponding to the liquid introduction portion 362 and the supply portion support portion 42 (FIG. 6) that are included in the attachment/detachment unit 30. The board unit 58 is a portion corresponding to the electric connection portion 382 and the board support portion 48 (FIG. 6) included in the attachment/detachment unit 30. Although the holding portion 54 of the operation member 53 is formed in a rectangular shape in this embodiment, it should be noted that the holding portion 54 may be formed in a "C" shape or a "T" shape.

The liquid containing portion 52 can contain the ink serving as the liquid. The liquid containing portion 52 is attached to the operation member 53 in a state where a bag face (outer surface) is exposed. That is to say, the liquid containing portion 52 is configured not to be housed in a case or the like and to be visible from the outside. The volume of the liquid containing portion 52 decreases with a decrease of the contained ink.

The liquid containing portion 52 has a first film 521, a second film 522, and a third film 523. The first to third films 521 to 523 demarcate a space portion for containing the ink on the inside thereof. Here, of the liquid containing portion 52, the side to which the operation member 53 is attached is the side of a first end portion (upper end portion) 501, and the side opposed to the first end portion 501 is the side of a second end portion (bottom end portion) 502. Furthermore, of the liquid containing portion 52, the first end portion side (the side in the +K2-axis direction) is the side of the first side end portion 503, and the second end portion side (the side in the −K2-axis direction) is the side of the second side end portion 504. The bottom end portion 502 serves as a gusset that can be folded to the inside at a crease 523*m* provided as a folding line in the third film 523 such that the first film 521 and the second film 522 overlap each other.

In the attached state of the liquid containing body 50, the first film 521 and the second film 522 constitute side faces of the liquid containing portion 52. Also, in the attached state of the liquid containing body 50, the third film 523 constitutes a bottom face of the liquid containing portion 52. The first film 521 and the second film 522 are arranged so as to face each other. A part of a peripheral region 51W of the first film 521 is adhered to that of the second film 522. Specifically, of the peripheral region 51W, a portion on the side of the first end portion 501, a portion on the side of the first side end portion 503, and a portion on the side of the second side end portion 504 are adhered. In order to facilitate understanding, in FIGS. 7 and 8, the portions where the first and second films 521 and 522 are adhered to each other are cross-hatched. The operation member 53 is adhered to the first end portion 501 (specifically, one end portion of the first and second films 521 and 522) of the liquid containing portion 52. That is to say, the operation member 53 is a member located at the first end portion 501 of the liquid containing portion 52. In order to facilitate understanding, in FIGS. 7 and 8, the adhered portions of the operation member 53 and the first and second films 521 and 522 are single-hatched with solid lines.

In the third film 523, a peripheral region 51Y of the third film 523 and a part of the peripheral regions 51W of the first film 521 and the second film 522 are adhered to each other. The portion at which the third film 523 is adhered to the first and second films 521 and 522 is single-hatched with alternate long and short dashed lines. Thus, the liquid containing portion 52 in this embodiment is of a type in which the three films 521, 522, and 523 are adhered by adhesion or the like (a so-called pouch type with a bottom face).

The first to third films 521 to 523 are flexible members. As the material of the first to third films 521 to 523, polyethylene terephthalate (PET), nylon, polyethylene, or the like is used, for example. The first to third films 521 to 523 may also be formed using a laminate structure in which a plurality of films made of the aforementioned material are laminated. In this laminate structure, for example, a configuration may be employed in which an outer layer is formed by PET or nylon that has excellent shock resistance, and an inner layer is formed by polyethylene that has an excellent anti-ink property. Furthermore, a film having a layer to which aluminum or the like is deposited may be used as a constituent member of the laminate structure. The gas barrier property can thereby be enhanced, and therefore, a concentration change of the ink contained in the liquid containing portion 52 can be suppressed, for example. Thus, the material of the liquid containing portion 52 can be arbitrarily set.

The shape and the size of the liquid containing portion 52 can be arbitrarily set. For example, the liquid containing portion 52K that contains the black ink may have a larger volume than the volume (size) of the liquid containing portion 52C that contains the other (e.g., cyan) color ink. Furthermore, for example, the liquid containing portion 52 in this embodiment is of a type in which the first to third films 521 to 523 are adhered by adhesion or the like. However, the liquid containing portion 52 may be of a type (so-called pillow type) in which the third film 523 is omitted, and the first and second films 521 and 523 are adhered by adhesion or the like. Here, as mentioned above, the liquid containing portion 52 and the operation member 53 are different members. Accordingly, the type (shape, size, material) of the liquid containing portion 52 can be easily changed while using the same parts for the operation member 53. That is to say, the shape, size, and material of the liquid containing portion 52 can be set in accordance with the characteristics, amount, and the like of the liquid to be contained in the liquid containing portion 52, and accordingly the degree of freedom in design can be improved.

The liquid containing body 50 further has a flow path member 70 for causing the ink contained in the liquid containing portion 52 to flow into the liquid supply unit 55 (specifically, the later-described liquid supply portion). In this embodiment, the flow path member 70 is a tube. The flow path member 70 is arranged within the liquid containing portion 52.

Figure 9:
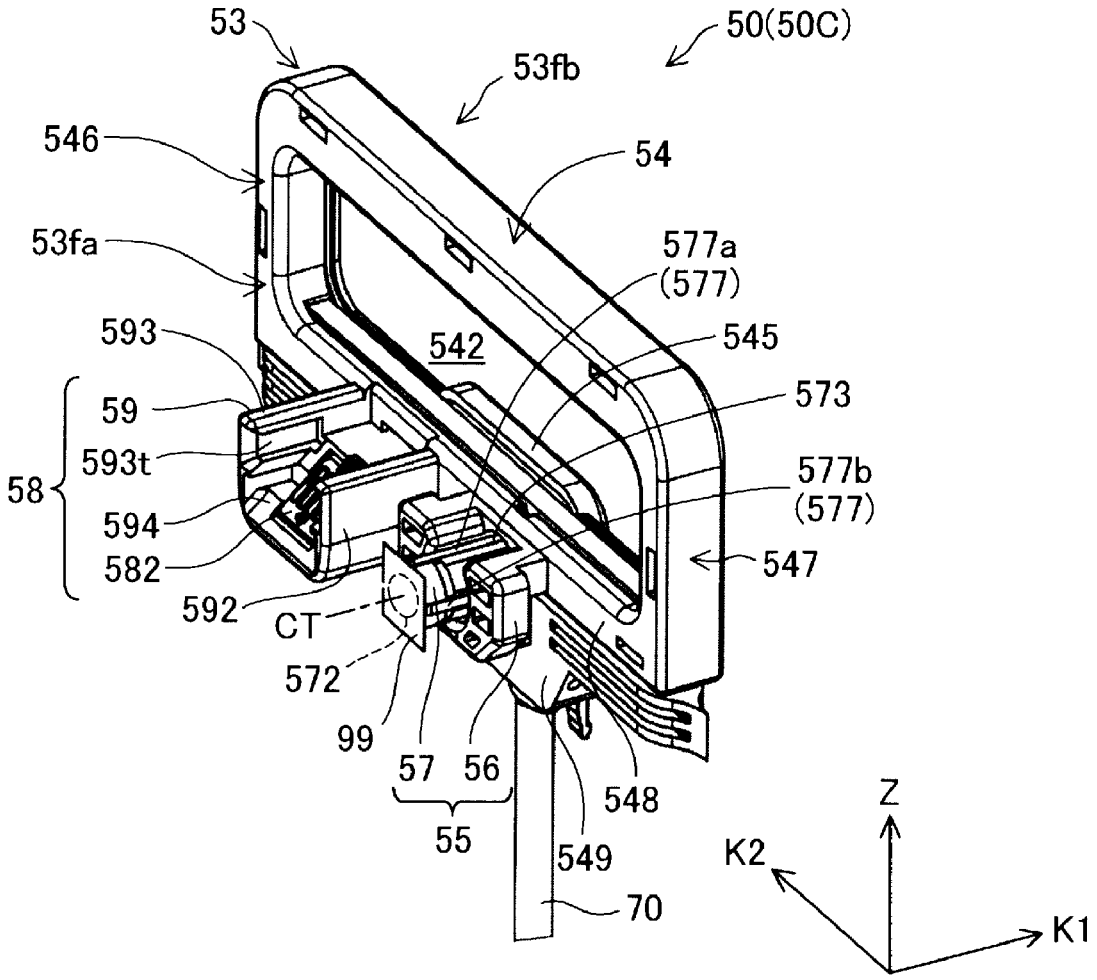
FIG. 9 is a first perspective view showing a part of the liquid containing body 50.
Figure 10:
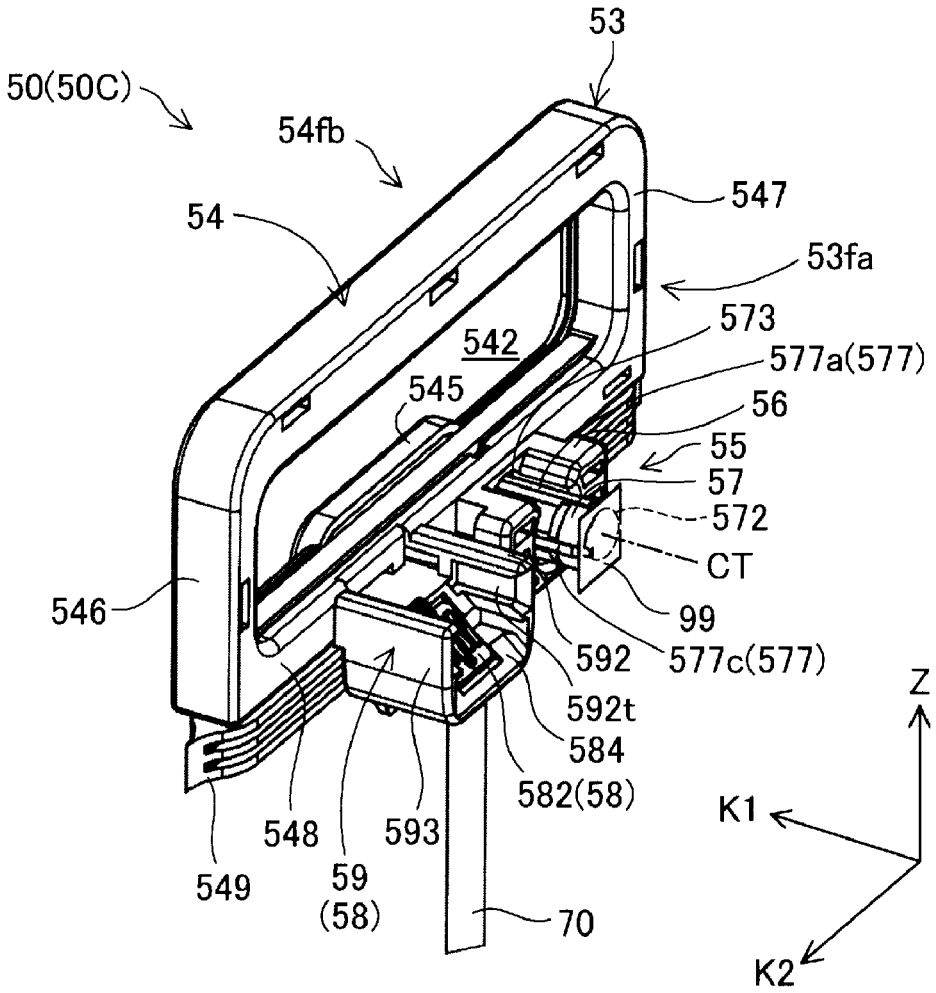
FIG. 10 is a second perspective view showing a part of the liquid containing body 50.
Figure 11:
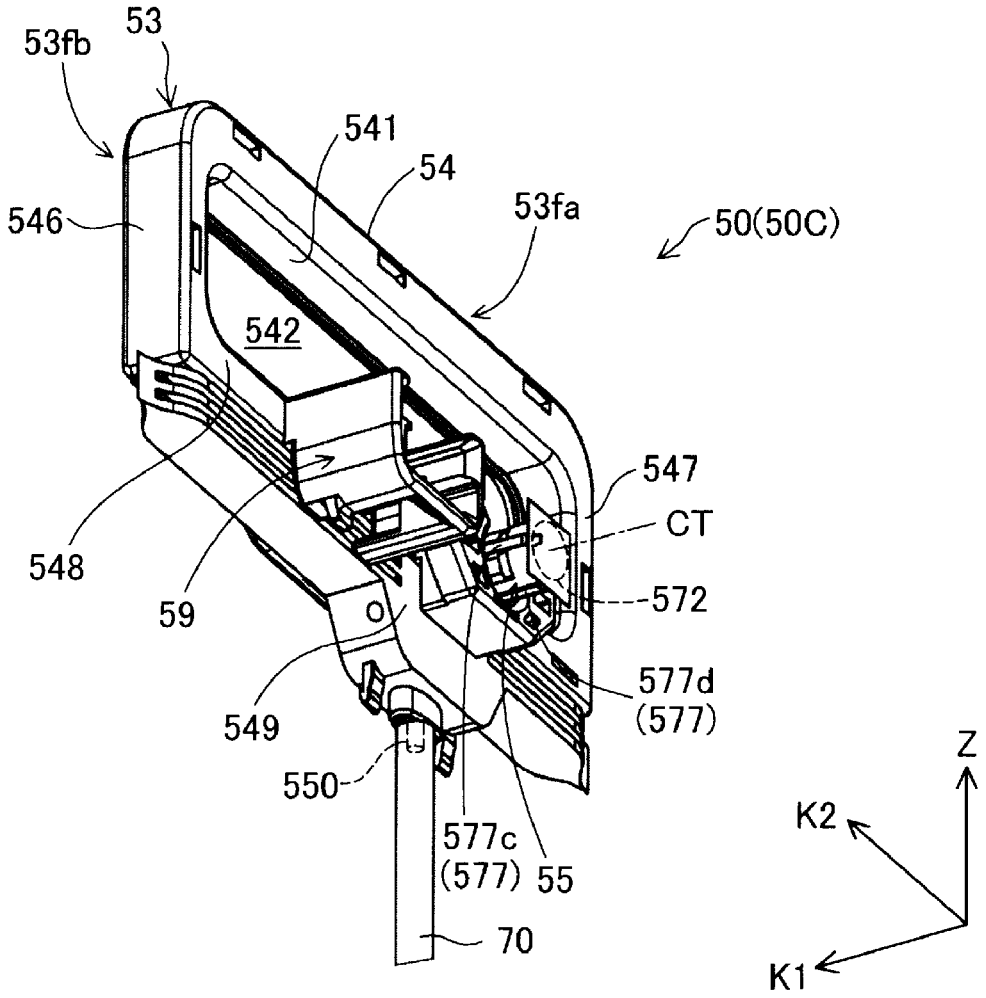
FIG. 11 is a third perspective view showing a part of the liquid containing body 50.
Figure 12:
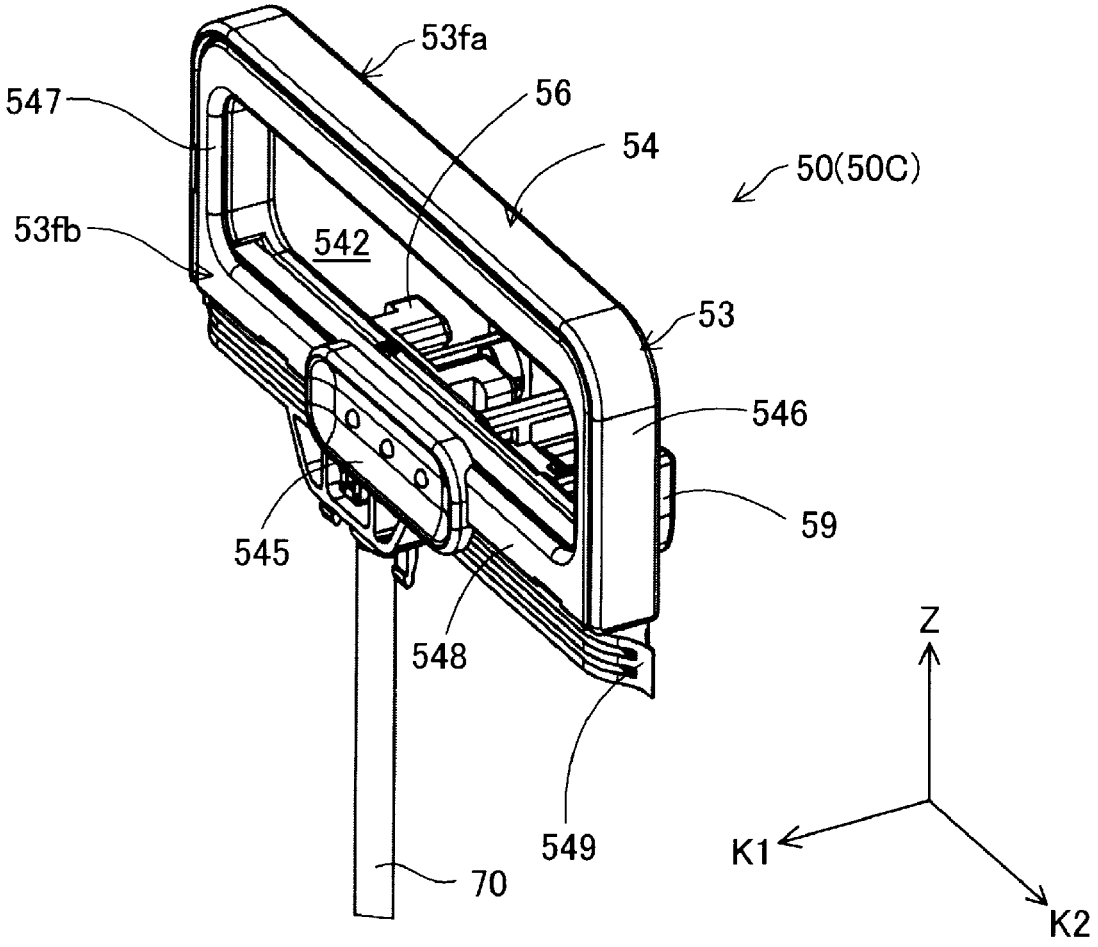
FIG. 12 is a fourth perspective view showing a part of the liquid containing body 50.
Figure 13:
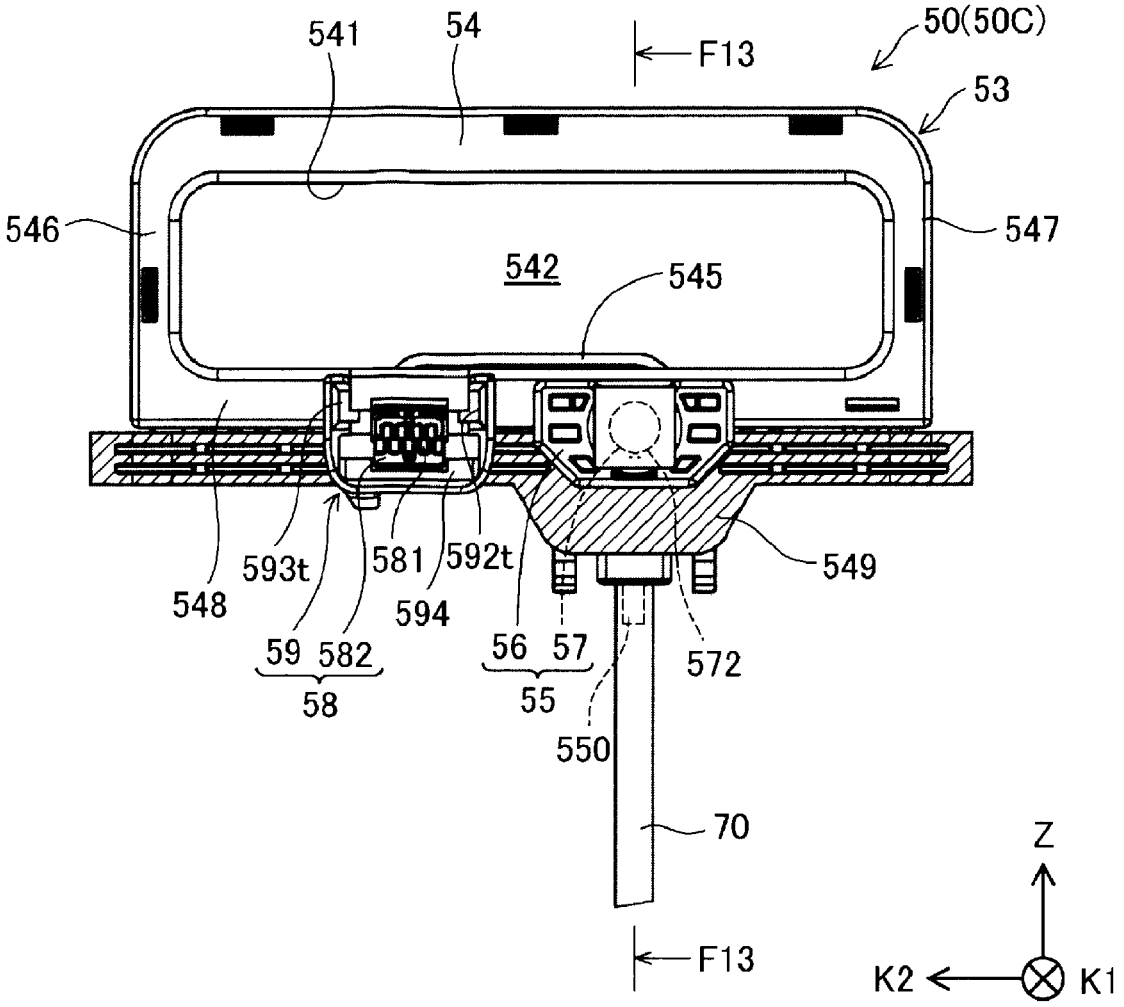
FIG. 13 is a front view of a part of the liquid containing body 50.
Figure 14:
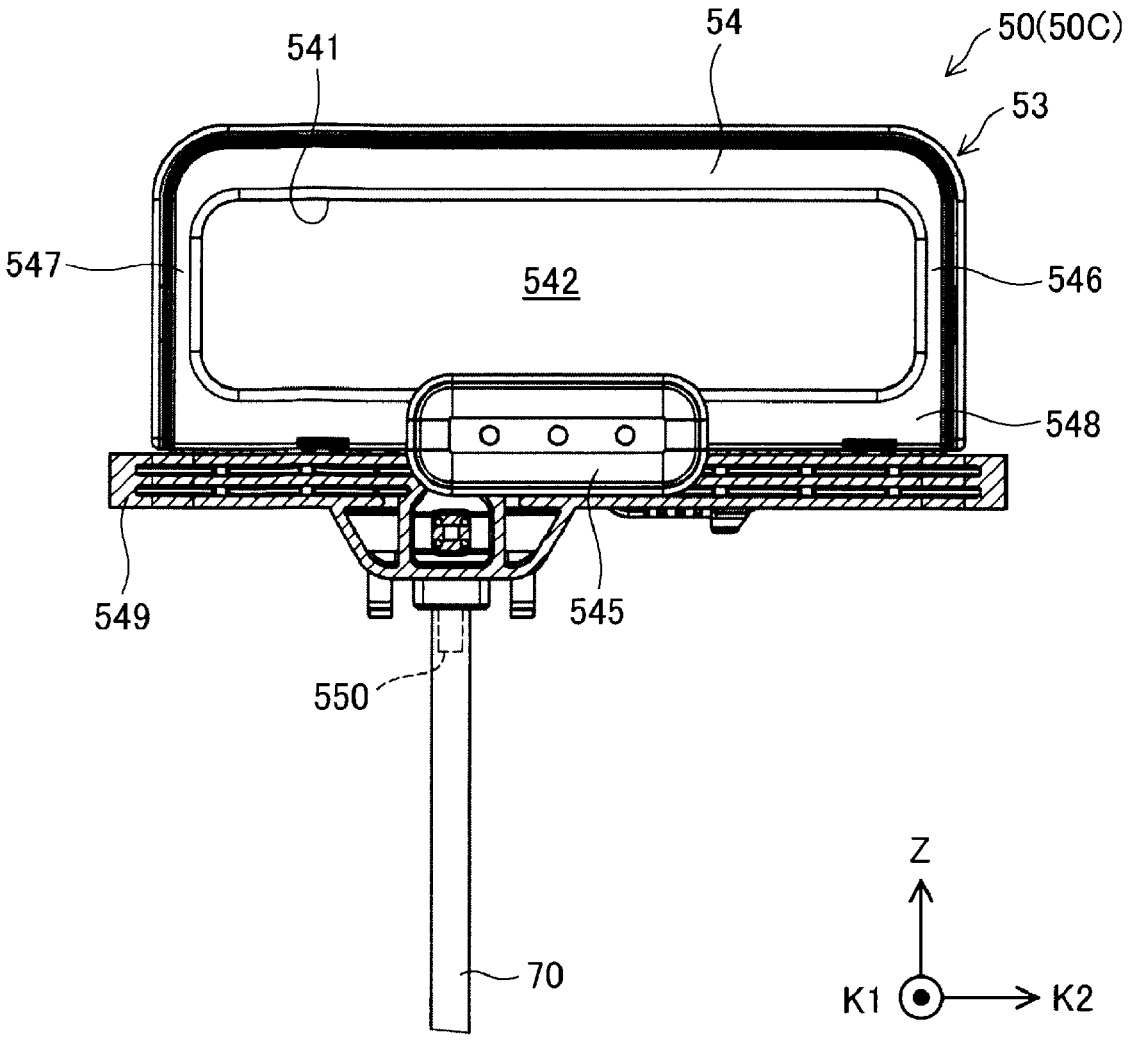
FIG. 14 is a back view of a part of the liquid containing body 50.
Figure 15:
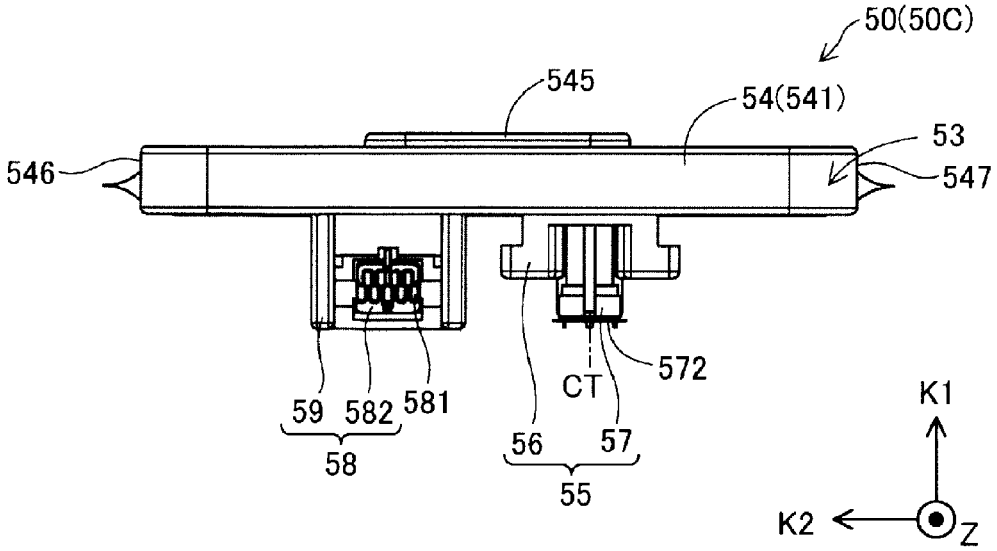
FIG. 15 is a top view of a part of the liquid containing body 50.
Figure 16:
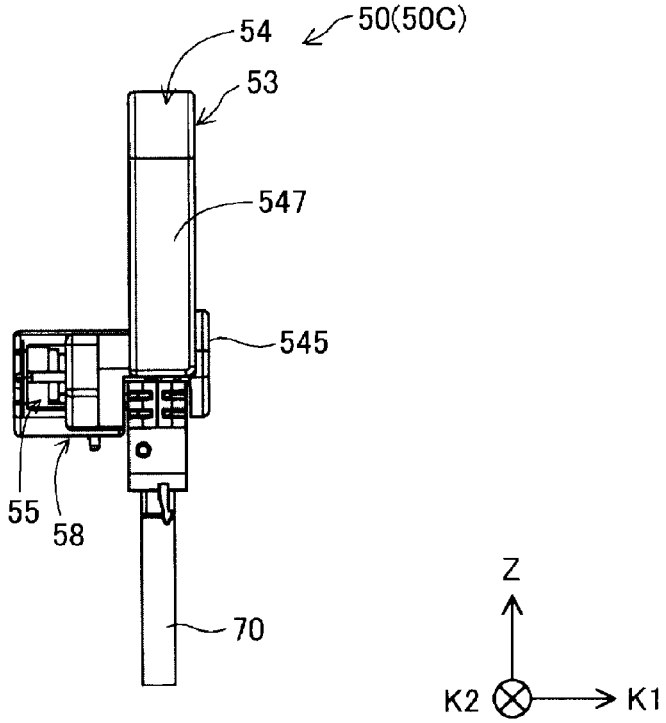
FIG. 16 is a right side view of a part of the liquid containing body 50.
Figure 17A:
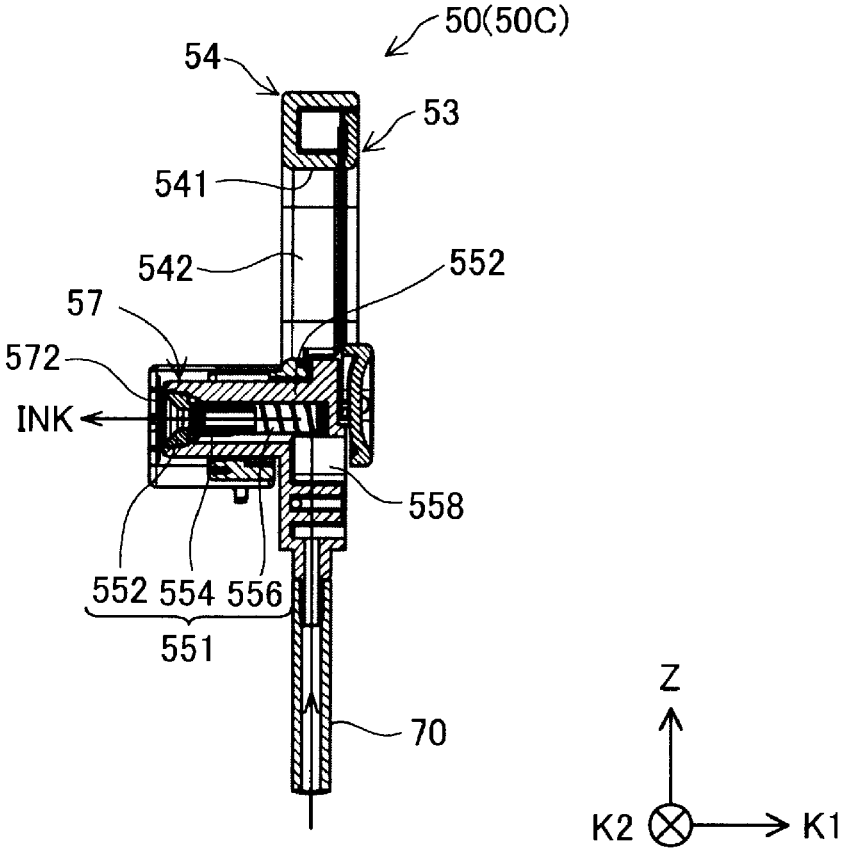
FIG. 17A is a cross-sectional view taken along line F13-F13 in FIG. 13.
Figure 17B:
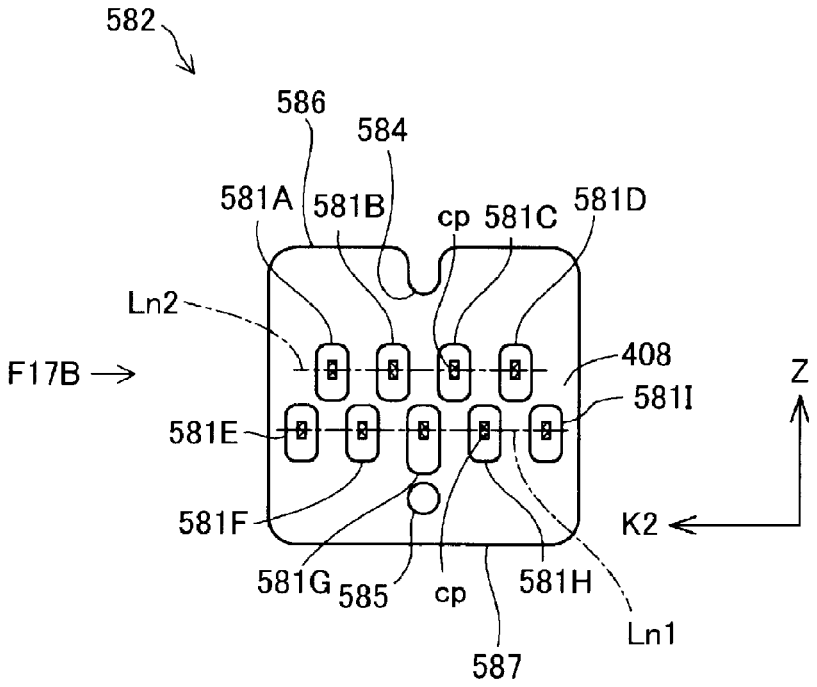
FIG. 17B is a front view of a circuit board 582.
Figure 17C:
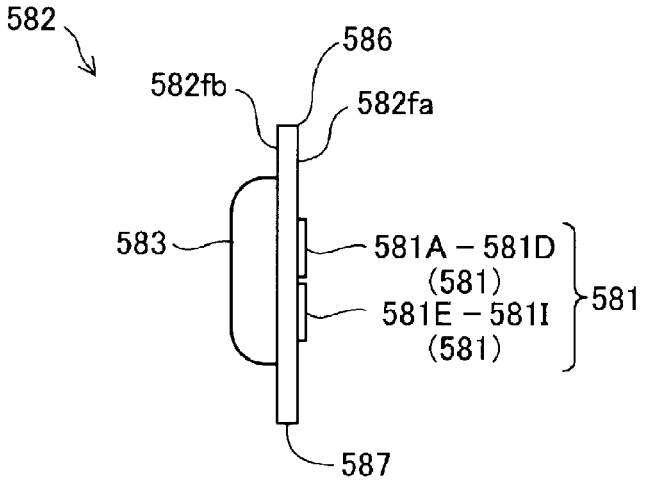
FIG. 17C shows the circuit board 582 as viewed along arrow F17B in FIG. 17B.

FIG. 9 is a first perspective view showing a part of the liquid containing body 50. FIG. 10 is a second perspective view showing a part of the liquid containing body 50. FIG. 11 is a third perspective view showing a part of the liquid containing body 50. FIG. 12 is a fourth perspective view showing a part of the liquid containing body 50. FIG. 13 is a front view of a part of the liquid containing body 50. FIG. 14 is a back view of a part of the liquid containing body 50. FIG. 15 is a top view of a part of the liquid containing body 50. FIG. 16 is a right side view of a part of the liquid containing body 50. FIG. 17A is a cross-sectional view taken along line F13-F13 in FIG. 13. FIG. 17B is a front view of the circuit board 582. FIG. 17C shows the circuit board 582 as viewed along arrow F17B in FIG. 17B. In FIGS. 9 to 17A, the liquid containing portion 52 included in the liquid containing body 50 is omitted.

As shown in FIGS. 9 and 10, the operation member 53 includes the holding portion 54, a first connection portion 546, a second connection portion 547, a base portion 548, and an attachment portion 549. Here, regarding the operation member 53, the Z-axis direction will also be called a "height direction", the K1-axis direction will also be called a "thickness direction", and the K2-axis direction will also be called a "width direction".

The holding portion 54, the first connection portion 546, the second connection portion 547, and the base portion 548 each have a bar shape. A frame-shaped member is formed by the holding portion 54, the first connection portion 546, the second connection portion 547, and the base portion 548. A receiving space portion 542 having a substantially rectangular shape for receiving a hand of the user is thereby demarcated and formed in the operation member 53.

The holding portion 54 is a portion at which the user holds the liquid containing body 50. The holding portion 54 extends in the K2-axis direction. As shown in FIG. 11, the holding portion 54 has a holding face (support face) 541 that is in contact with the receiving space portion 542. The holding face 541 is a portion that is directly supported (held) by the user. The holding face 541 is a flat surface that is substantially vertical to the Z-axis direction when in the attached state.

As shown in FIG. 9, the first connection portion 546 is a member extending from one end portion of the holding portion 54 in the K2-axis direction toward the side of the base portion 548 (the side in the −Z-axis direction, the side of the liquid containing portion 52 shown in FIG. 7). The second connection portion 547 is a member extending from the other end portion of the holding portion 54 in the K2-axis direction toward the side of the base portion 548 (the side in the −Z-axis direction, the side of the liquid containing portion 52 shown in FIG. 7). The base portion 548 is a portion opposed to the holding portion 54 with the receiving space portion 542 therebetween. The base portion 548 extends in the K2-axis direction. A positioning portion 56, a circuit board holding portion (contact portion arrangement portion) 59, and the press portion 545 (FIG. 12), which will be described later, are attached to the base portion 548.

The attachment portion 549 is located on the side opposite to the side on which the holding portion 54 is located with the base portion 548 therebetween. The attachment portion 549 is adjacent to the base portion 548. The attachment portion 549 extends in the K2-axis direction. The attachment portion 549 is a portion to which a first end portion 501 (FIG. 7) of the liquid containing portion 52 is attached by adhesion or the like. As shown in FIGS. 13 and 17A, the attachment portion 549 has a lead-out portion 550 for causing the ink contained in the liquid containing portion 52 to flow into the liquid supply portion 57. As a result of the lead-out portion 550 being connected to the flow path member 70, the ink that has flown through the flow path member 70 flows into the liquid supply portion 57 via the lead-out portion 550. Note that, in order to facilitate understanding, a portion of the attachment portion 549 to which the liquid containing portion 52 is attached is single-hatched in FIGS. 13 and 14.

As shown in FIGS. 9 and 10, the liquid supply unit 55 includes the liquid supply portion 57 and the positioning portion 56. Here, the positioning portion 56 is configured as a body separate from the liquid supply portion 57, and a small gap is formed between the positioning portion 56 and the liquid supply portion 57. The liquid supply unit 55 is provided so as to project in the −K1-axis direction of the operation member 53.

The liquid supply portion 57 has a liquid supply port 572, which is one end, and a supply connection portion 573, which is the other end. The liquid supply port 572 is in communication with the inside of the liquid containing portion 52, and guides the ink contained in the liquid containing portion 52 to the outside (printer 10). The liquid supply port 572 defines a flat surface (a face defined by the Z-axis direction and the K2-axis direction) vertical to the holding face 541. The supply connection portion 573 is connected to the operation member 53. The liquid supply portion 57 is a tubular member (ring-shaped member) extending in the K1-axis direction (the direction of a center axis CT). The liquid supply unit 57 is provided so as to project in the −K1-axis direction of the operation member 53.

The liquid supply portion 57 has the center axis CT. The center axis CT is parallel with the K1-axis direction. Here, of the K1-axis direction, the direction extending from the liquid supply port 572 toward the supply connection portion 573 is a +K1-axis direction, and the direction extending from the supply connection portion 573 toward the liquid supply port 572 is a −K1-axis direction. The liquid supply unit 55 having the above-described configuration guides the ink contained in the liquid containing body 50 from the liquid containing body 50 to the outside in cooperation with the flow path member 70.

As shown in FIG. 15, the holding face 541 is arranged on the side in a direction (+Z-axis direction) vertical to the direction (K1-axis direction) of the center axis CT of the liquid supply portion 57. The operation member 53 including the holding face 541 is provided so as to be offset in the direction of the center axis CT with respect to the liquid supply port 572. In other words, when the liquid containing body 50 is viewed from the side in the direction that is orthogonal to the holding face 541 and extends from the liquid supply port 57 toward the holding face 541 (+Z-axis direction), the liquid supply port 572 is arranged at a position that does not overlap the holding face 541 (operation member 53). That is to say, when the liquid containing body 50 is projected onto a plane parallel with the holding face 541, the holding face 541 and the liquid supply port 572 are in a positional relationship in which they do not overlap each other.

As shown in FIG. 9, in an unused liquid containing body 50, the liquid supply port 572 is closed by a film 99. It is thereby possible to suppress leakage of the ink from the liquid supply port 572 to the outside before the liquid containing body 50 is attached to the attachment/detachment unit 30 (FIG. 5). The film 99 is torn by the liquid introduction portion 362 (FIG. 5) when the liquid containing body 50 is attached to the attachment/detachment unit 30.

As shown in FIG. 17A, a valve mechanism 551 for opening and closing a liquid flow path formed by the liquid supply portion 57 is arranged within the liquid supply portion 57. The valve mechanism 551 includes a valve seat 552, a valve body 554, and a spring 556. The valve seat 552, the valve body 554, and the spring 556 are housed in this order within the liquid supply portion 57 from the liquid supply port 572 toward the supply connection portion 573 in the liquid supply portion 57.

The valve seat 552 is a substantially ring-shaped member. The valve seat 552 is constituted by an elastic body such as rubber or elastomer, for example. The valve seat 552 is press-fit to the inside of the liquid supply portion 57. The valve body 554 is a member having a substantially circular column shape. The valve body 554 blocks a hole (valve hole) formed in the valve seat 552 in a state before the liquid containing body 50 is attached to the attachment/detachment unit 30. The spring 556 is a compression coil spring. The spring 556 biases the valve body 554 in a direction extending toward the side of the valve seat 552. In the attached state of the liquid containing body 50, the valve body 554 moves toward the side of the supply connection portion 573 by the liquid introduction portion 362 (FIG. 5) pressing the valve body 554 toward the side of the supply connection portion 573. The valve body 554 thereby moves away from the valve seat 552, and the valve mechanism 551 enters an open state. When the valve mechanism 551 is in an open state, the ink contained in the liquid containing portion 52 (FIG. 7) can flow to the outside through the flow path member 70, and an inner flow path 558 and the liquid supply portion 57 in the operation member 53.

As shown in FIG. 9, the positioning portion 56 positions the liquid containing body 50 including the liquid supply port 572 with respect to the printer 10 to some extent when the liquid containing body 50 (liquid containing body) is connected to the printer 10. The positioning portion 56 is integrally provided with the operation member 53. In this embodiment, the positioning portion 56 is integrally provided with the operation member 53 by being produced together with the operation member 53 by integral molding. Here, "to be integrally provided" means that the positioning portion 56 is provided in the operation member 53 so as to move with the movement of the operation member 53. In another embodiment, the positioning portion 56 may be integrally provided with the operation member 53 by attaching the positioning portion 56 to the operation member 53 by adhesion or the like. Although the positioning portion 56 is provided near the liquid supply port 572 so as to surround the liquid supply port 572 in the circumferential direction excluding the upper side thereof, if the operation member 53 is made of a material that does not easily deform, the positioning portion 56 may be provided at a position on the operation member 53 that is slightly separate from the liquid supply port 572. The positioning portion 56 projects in the −K1-axis direction from the operation member 53.

As shown in FIGS. 9 and 10, the positioning portion 56 is arranged near the liquid supply port 572. Also, as shown in FIG. 13, at least a part of the positioning portion 56 is provided on the side of the liquid containing portion 52 (FIG. 7) (the side in the −Z-axis direction) with respect to the liquid supply port 572. In this embodiment, the positioning portion 56 is arranged at the periphery of the liquid supply portion 57 with the center axis CT as the center. Specifically, the positioning portion 56 is arranged at the periphery of the liquid supply portion 57 excluding the periphery thereof on the side of the holding portion 54. The positioning portion 56 is arranged within the supply portion support portion 42 provided in the attachment/detachment unit 30 (FIG. 5), when the liquid containing body 50 is connected to the printer 10. Movement of the liquid supply portion 57 is thereby restricted as a result of a plurality of face portions (e.g., the first support face portion 402, the second support face portion 403, and the third support face portion 404 shown in FIG. 5) that demarcate and form the supply portion support portion 42 abutting against the positioning portion 56, and the liquid containing body 50 is positioned to some extent. Thereafter, the liquid supply port 572 is connected to the liquid introduction portion 362 in a state of having been positioned by protrusions 577*a* to 577*d* (FIGS. 9 to 11) each serving as a containing body-side positioning portion. The protrusions 577*a* to 577*d* are provided in the outer circumference of the liquid supply portion 57 with the center axis CT as the center. The protrusions 577*a* to 577*d* are provided in the liquid supply portion 57 at upper, lower, left, and right positions of the liquid supply port 572. Specifically, as shown in FIG. 9, a first protrusion 577*a* is arranged at a part of the liquid supply portion 57 on the side in the upward direction with respect to the gravity (the side in the +Z-axis direction). A second protrusion 577*b* is arranged in a part of the liquid supply portion 57 on the side in the −K2-axis direction. As shown in FIG. 10, a third protrusion 577*c* is arranged in a part of the liquid supply portion 57 on the side in the +K2-axis direction. As shown in FIG. 11, a fourth protrusion 577*d* is arranged in a part of the liquid supply portion 57 on the side in the downward direction with respect to the gravity (the side in the −Z-axis direction). Note that a reference numeral "577" will be used when not distinguishing among the first to fourth protrusions 577*a* to 577*d*.

The liquid supply unit 55 has a function of supplying the ink contained in the liquid containing portion 52 (FIG. 7) to the printer 10. Accordingly, the liquid supply unit 55 can be considered to be a "liquid supply portion". In this case, the liquid supply unit 55 serving as the liquid supply portion has the liquid supply portion 57 having the liquid supply port 572 at one end, and the positioning portion 56.

As shown in FIGS. 9 and 10, the board unit (containing body-side electric connection portion) 58 includes the circuit board 582 and the circuit board holding portion 59. The board unit 58 is provided so as to project in the −K1-axis direction of the operation member 53. The protruding direction of the board unit 58 is the same as the protruding direction (−K1-axis direction) of the liquid supply portion 57. Note that the protruding direction of the board unit 58 and the protruding direction of the liquid supply portion 57 may not be the same, and need only be substantially parallel with each other. Also, the board unit 58 and the liquid supply portion 57 protrude from the operation member 53 toward the same side (the side in the −K1-axis direction) with respect to the operation member 53.

As shown in FIG. 15, the board unit 58 and the liquid supply unit 55 are provided side-by-side in a direction parallel with the holding face 541. Specifically, the board unit 58 and the liquid supply unit 55 are arranged side-by-side in the K2-axis direction that is parallel with the holding face 541 and orthogonal to the center axis CT.

As shown in FIG. 9, the circuit board holding portion 59 positions the circuit board 582 with respect to the printer 10 when the liquid containing body 50 is connected to the printer 10. The circuit board holding portion 59 is integrally provided with the operation member 53. In this embodiment, the circuit board holding portion 59 is integrally provided with the operation member 53 by being produced together with the operation member 53 by integral molding. Here, "to be integrally provided" means that the circuit board holding portion 59 is provided in the operation member 53 so as to move with the movement of the operation member 53. In another embodiment, it should be noted that the circuit board holding portion 59 may be integrally provided with the operation member 53 by attaching the circuit board holding portion 59 to the operation member 53 by adhesion or the like.

The circuit board holding portion 59 has a dent shape opening on the side in the +Z-axis direction (the side on which the holding portion 54 is located). A bottom portion 594 of the dent shape inclines with respect to the holding face 541 (FIG. 11). As a result of the circuit board 582 being attached to the bottom portion 594, the circuit board 582 is held by the circuit board holding portion 59 so as to incline as mentioned above. At least a part (the bottom portion 594) of the circuit board holding portion 59 is provided on the side of the liquid containing portion 52 (FIG. 7) (the side in the −Z-axis direction) with respect to the circuit board 582. That is to say, at least a part (the bottom portion 594) of the board unit (containing body-side electric connection portion) 58 that is different from contact portions cp (FIG. 17B) is provided on the side of the liquid containing portion 52 with respect to the contact portions cp.

The circuit board holding portion 59 has a first side wall portion 592 and a second side wall portion 593 that extend from both sides of the bottom portion 594 in the K2-axis direction toward the side in the +Z-axis direction. As shown in FIG. 10, the first side wall portion 592 has a groove portion 592t. As shown in FIG. 9, the second side wall portion 593 has a groove portion 593t. When the liquid containing body 50 is connected to the printer 10, the circuit board holding portion 59 is first supported by the board support portion 48 (FIG. 5). The circuit board holding portion 59 and the circuit board 582 are thereby positioned with respect to the apparatus-side terminals 381 (FIG. 5) to some extent. Then, by moving the movable member 40 of the attachment/detachment unit 30 shown in FIG. 5 in the −K1-axis direction, the apparatus-side positioning portion 385 shown in FIG. 6 enters the groove portion 593t (FIG. 9) of the circuit board holding portion 59, and the apparatus-side board positioning portion 384 shown in FIG. 6 enters the groove portion 592t (FIG. 10) of the circuit board holding portion 59. The circuit board holding portion 59 and the circuit board 582 are thereby positioned with respect to the apparatus-side terminals 381.

As shown in FIG. 13, the circuit board 582 has the plurality of terminals 581 on the surface. In this embodiment, nine terminals 581 are provided so as to correspond to the number of (nine) apparatus-side terminals 381. In this embodiment, the outer shape of each terminal 581 is a substantially rectangular shape. A storage device 583 (FIG. 17C) is arranged on the back face of the circuit board 582. The storage device 583 stores information (e.g., the amount of remaining ink, ink color) regarding the liquid containing body 50. The storage device 583 is electrically connected to the plurality of terminals 581. In the attached state, the plurality of terminals 581 are electrically connected to the respective apparatus-side terminals 381 (FIG. 6) in the electric connection portion 382 provided in the printer 10.

As shown in FIG. 17B, a boss groove 584 is formed in an upper end portion 586 of the circuit board 582 on the side in the +Z-axis direction, and a boss hole 585 is formed in a lower end portion 587 of the circuit board 582 on the side in the −Z-axis direction. The circuit board 582 is fixed to the bottom portion (arrangement portion) 594 using the boss groove 584 and the boss hole 585.

As shown in FIGS. 17B and 17C, the circuit board 582 has a liquid containing body-side terminal group 580 provided in a front face 582*fa*, and the storage device 583 provided on a back face 582*fb*. The front face 582*fa* and the back face 582*fb* are flat surfaces.

The liquid containing body-side terminal group 580 includes nine terminals 581A to 5811. The storage device 583 stores information (e.g., the amount of remaining ink, ink color) and the like regarding the liquid containing body 50.

As shown in FIG. 17B, the nine liquid containing body-side terminals 581A to 5811 are each formed in a substantially rectangular shape, and are arranged so as to form two lines Ln1 and Ln2 at different positions in the Z-axis direction. The lines Ln1 and Ln2 are parallel with the K2-axis direction.

The liquid containing body-side terminals 581A to 581I each have, at the center thereof, a contact portion cp that comes into contact with the corresponding apparatus-side terminal 381 (FIG. 6). The above lines Ln1 and Ln2 can be considered to be lines formed by the plurality of contact portions cp. Note that a reference numeral "581" will be used when not distinguishing among the nine liquid containing body-side terminals 581A to 5811. Regarding the relationship between the attachment/detachment unit 30 and the contact point mechanism 38, the plurality of liquid containing body-side terminals 581 in the liquid containing body 50 can come into contact with the plurality of apparatus-side terminals 381 that the contact point mechanism 38 has, and are provided in the operation member 53.

Thus, the containing body-side electric connection portion 58 has the contact portions cp capable of coming into contact with the apparatus-side electric connection portion 382. As shown in FIG. 9, the containing body-side electric connection portion 58 is integrally provided with the operation member 53.

As shown in FIG. 15, the holding face 541 is arranged on the side in a direction (+Z-axis direction) vertical to the direction of the center axis CT of the liquid supply portion 57. The board unit 58 serving as the containing body-side electric connection portion is provided so as to be offset in the direction of the center axis CT with respect to the operation member 53 including the holding face 541. In other words, when the liquid containing body 50 is viewed from the side in the direction (+Z-axis direction) that is orthogonal to the holding face 541 and extends from the liquid supply portion 57 toward the holding face 541, the board unit 58 is arranged at a position that does not overlap the holding face 541 (operation member 53). That is to say, when the liquid containing body 50 is projected onto a plane parallel with the holding face 541, the holding face 541 and the board unit 58 are in a positional relationship in which they do not overlap each other. In this case, at least the circuit board 582 of the board unit 58 need only be arranged at a position that does not overlap the holding face 541 (the operation member 53).

As shown in FIGS. 9 and 12, it is assumed that the side of the operation member 53 in the −K1-axis direction is a first side 53*fa*, and the side of the operation member 53 on the side in the +K1-axis direction that is opposite to the first side 53*fa* is a second side 53*fb*. As shown in FIG. 9, the circuit board holding portion 59 (the board unit 58) and the positioning portion 56 are provided on the same side, i.e., the first side 53*fa*.

As shown in FIG. 12, the press portion 545 is provided on the second side 53*fb* that is opposed to the positioning portion 56 and the circuit board holding portion 59 (the board unit 58) with the operation member 53 therebetween. That is to say, as shown in FIG. 11, the positioning portion 56 and the circuit board holding portion 59 are provided on the surface of the base portion 548 on the first side 53*fa*, and on the other hand, as shown in FIG. 12, the press portion 545 is provided on the surface of the base portion 548 on the second side 53*fb*. Also, as shown in FIGS. 15 and 16, at least a part of the press portion 545 is opposed to the positioning portion 56 and the circuit board holding portion 59 with the operation member 53 therebetween.

The press portion 545 is a portion to be pressed by the user when connecting the liquid containing body 50 to the printer 10. That is to say, the press portion 545 is a portion to be manually pressed. As a result of the press portion 545 being pressed toward the side in the −K1-axis direction, the movable member 40 (FIG. 6) to which the liquid containing body 50 is set is moved toward the side in the −K1-axis direction.

The press portion 545 is provided so as to project from the operation member 53 in the +K1-axis direction. Thereby, the press portion 545 can be easily distinguished from other portions, and it is possible to prompt the user to perform an operation of pressing the press portion 545 when connecting the liquid containing body 50 to the printer 10. As shown in FIG. 14, when the operation member 53 is viewed in a direction parallel with the K1-axis direction, a part of the outer shape of the press portion 545 protrudes outward of the base portion 548. The surface area of the press portion 545 can thereby be increased, and accordingly the user can easily press the press portion 545.

The operation member 53, the circuit board holding portion 59, the positioning portion 56, the liquid supply portion 57, and the press portion 545 may be formed by the same material, or may be formed by different materials in accordance with the usage. The material of the operation member 53 may be a synthetic resin such as polyethylene (PE), polypropylene (PP), or ABS resin, for example.

A-4. Method for Attaching Liquid Containing Body 50 to Attachment/Detachment Unit 30

Figure 18:
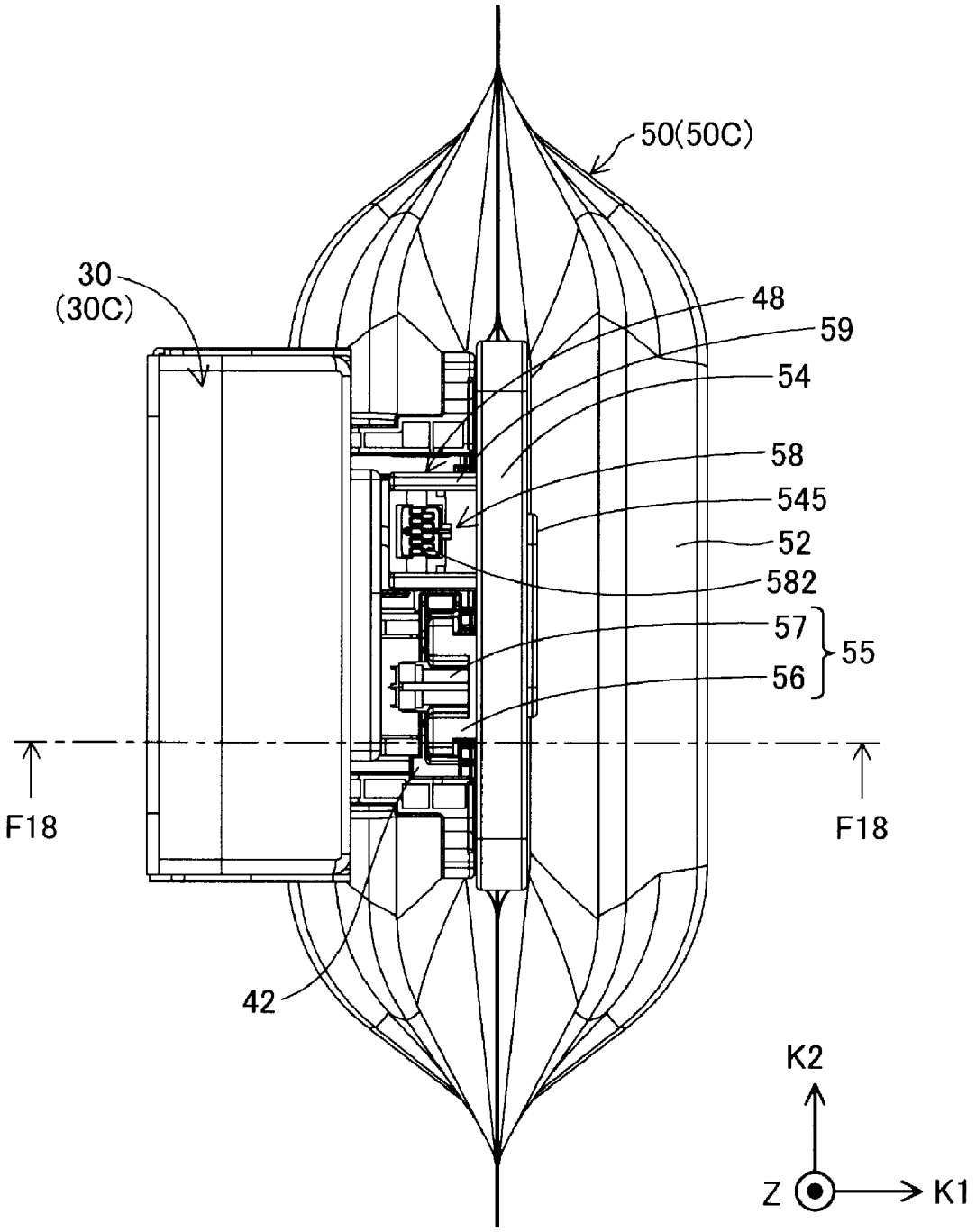
FIG. 18 is a view of the liquid containing body 50 when being set to the attachment/detachment unit 30.
Figure 19:
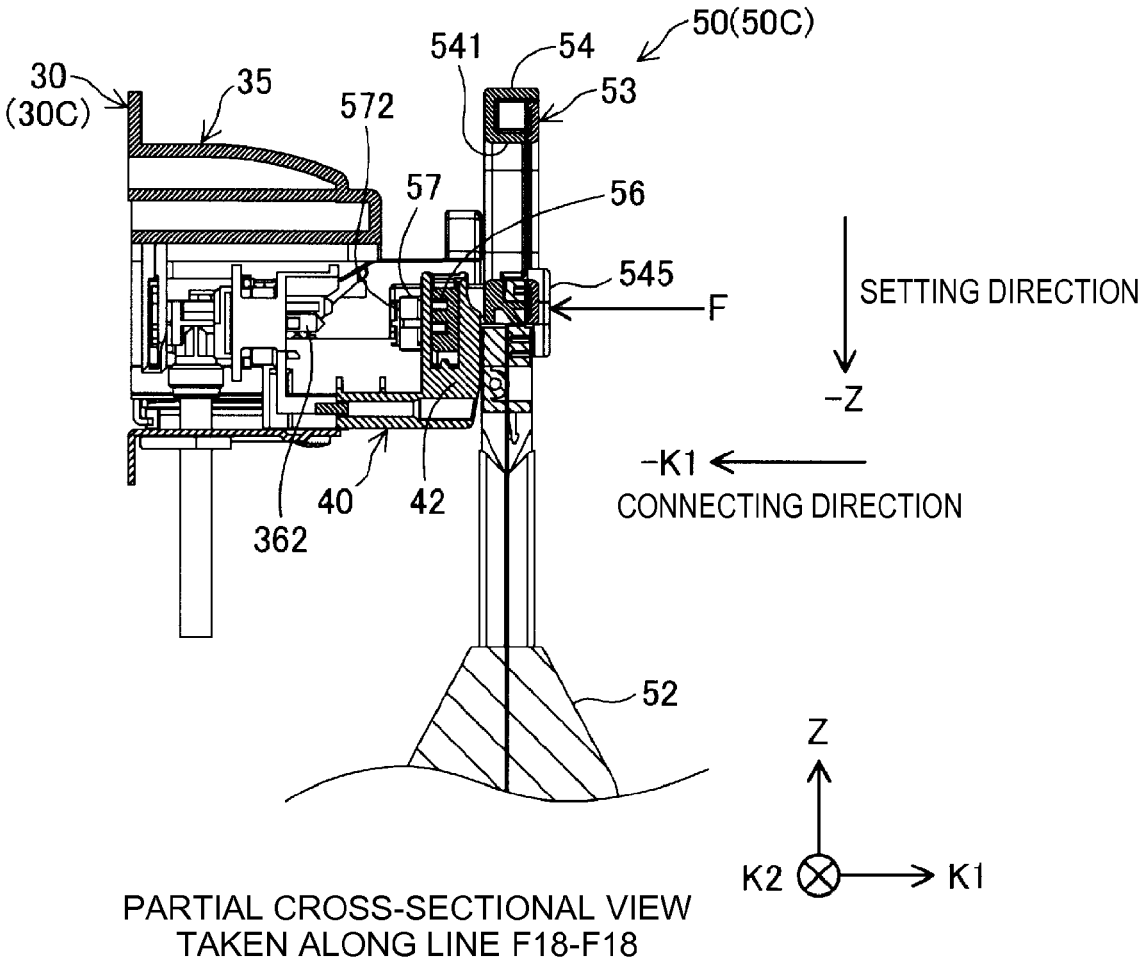
FIG. 19 is a partial cross-sectional view taken along line F18-F18 in FIG. 18.
Figure 20:
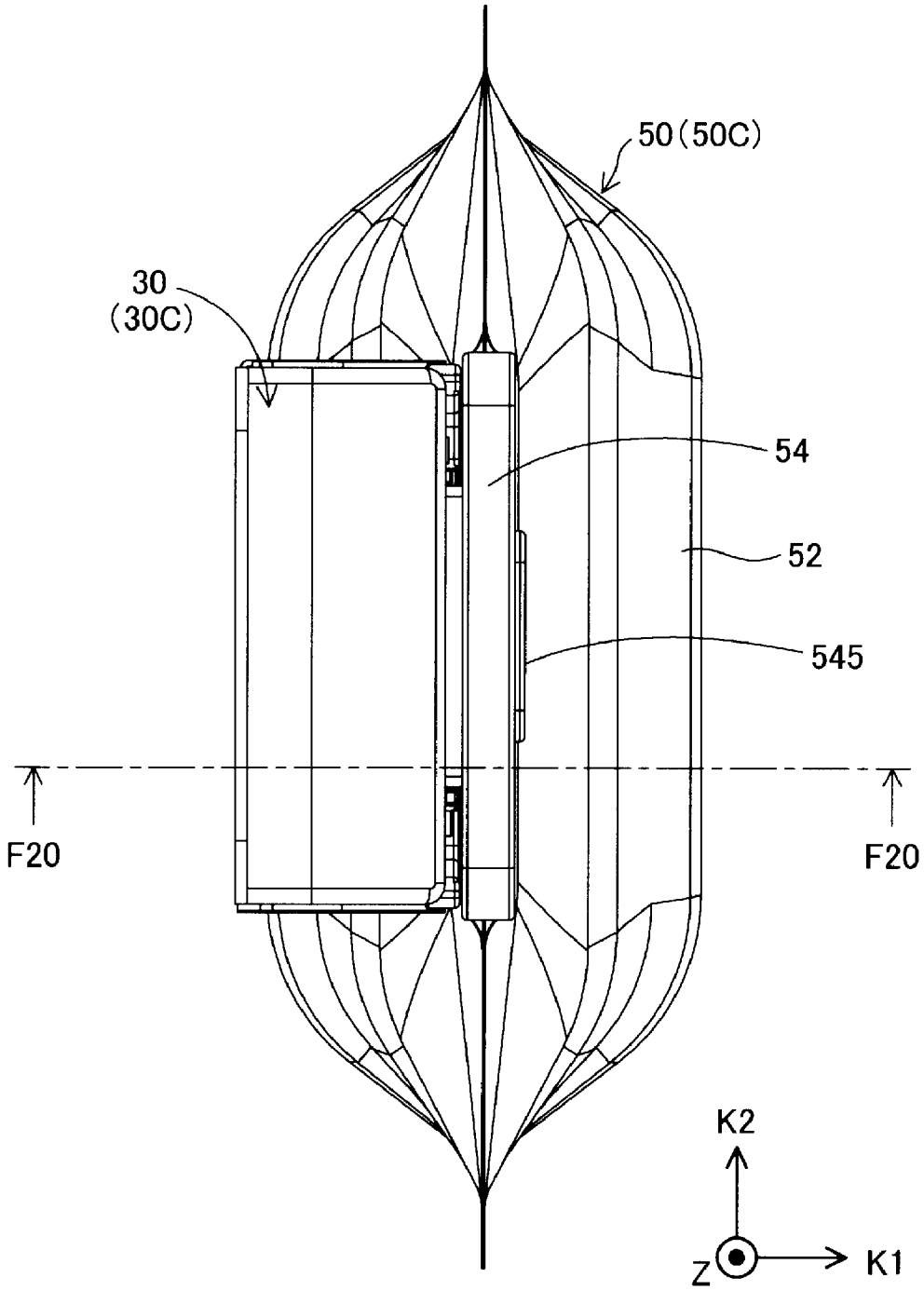
FIG. 20 is a view of the liquid containing body 50 when being attached to the attachment/detachment unit 30.
Figure 21:
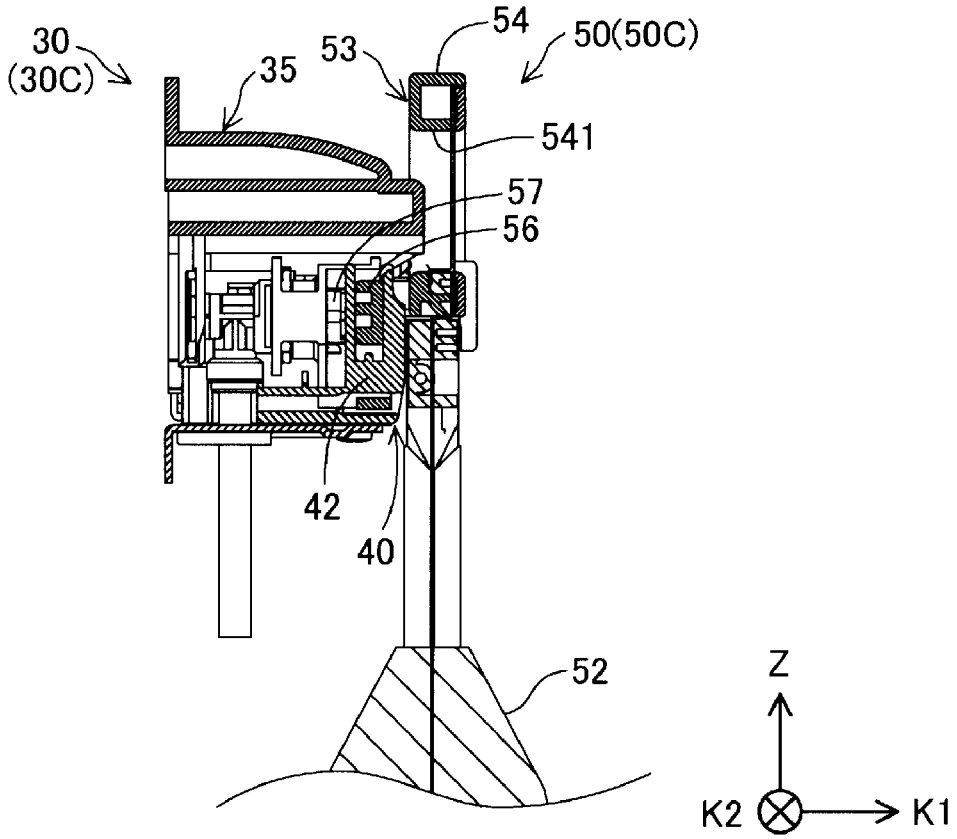
FIG. 21 is a partial cross-sectional view taken along line F20-F20 in FIG. 20.

FIG. 18 is a view of the liquid containing body 50 when being set to the attachment/detachment unit 30. FIG. 19 is a partial cross-sectional view taken along line F18-F18 in FIG. 18. FIG. 20 is a view of the liquid containing body 50 when being attached to the attachment/detachment unit 30. FIG. 21 is a partial cross-sectional view taken along line F20-F20 in FIG. 20. The state of the attachment/detachment unit 30 shown in FIGS. 18 and 19 is the first state as in FIG. 5. The state of the attachment/detachment unit 30 shown in FIGS. 20 and 21 is the second state as in FIG. 6.

As shown in FIG. 19, when attaching the liquid containing body 50 to the attachment/detachment unit 30, two operations are performed, which are an operation (a setting operation or a first operation) of moving the liquid containing body 50 in a setting direction, and an operation (a connecting operation or a second operation) of moving the liquid containing body 50 in a connecting direction. The setting direction is a direction including a component in the vertically downward direction (the −Z-axis direction). In this embodiment, the setting direction is the vertically downward direction.

The user sets the liquid containing body 50 to the movable member 40 of the attachment/detachment unit 30 that is in the first state. Specifically, the user holds the holding portion 54 in a state where the operation member 53 is further on the side in the vertically upward direction than the liquid containing portion 52. Then, as shown in FIGS. 18 and 19, the user arranges the positioning portion 56 of the liquid containing body 50 into the supply portion support portion 42, and arranges the circuit board holding portion 59 within the board support portion 48.

After the liquid containing body 50 is set to the movable member 40, the user presses the press portion 545 in the −K-axis direction toward the movable member 40, as indicated by arrow F in FIG. 19. The liquid containing body 50 and the movable member 40 thereby move in the connecting direction (the −K1-axis direction).

As shown in FIG. 21, in the second state of the attachment/detachment unit 30 with the movable member 40 housed in the fixed member 35, the liquid introduction portion 362 (FIG. 19) is inserted (connected) to the inside of the liquid supply portion 57. In the second state, the circuit board 582 is electrically connected to the electric connection portion 382 as a result of the terminals 581 (FIG. 13) of the circuit board 582 coming into contact with the apparatus-side terminals 381 (FIG. 6) of the electric connection portion 382.

The aforementioned connection of the liquid introduction portion 362 of the attachment/detachment unit 30 to the liquid supply portion 57 of the liquid containing body 50 and the electric connection between the circuit board 582 of the liquid containing body 50 and the electric connection portion 382 of the attachment/detachment unit 30 are simultaneously performed when attaching the liquid containing body 50. When attaching the liquid containing body 50, the attachment/detachment unit 30 supports a part, i.e., an upper end of the liquid containing body 50 in a state where the liquid containing body 50 is exposed, as shown in FIGS. 20 and 21.

Figure 22:
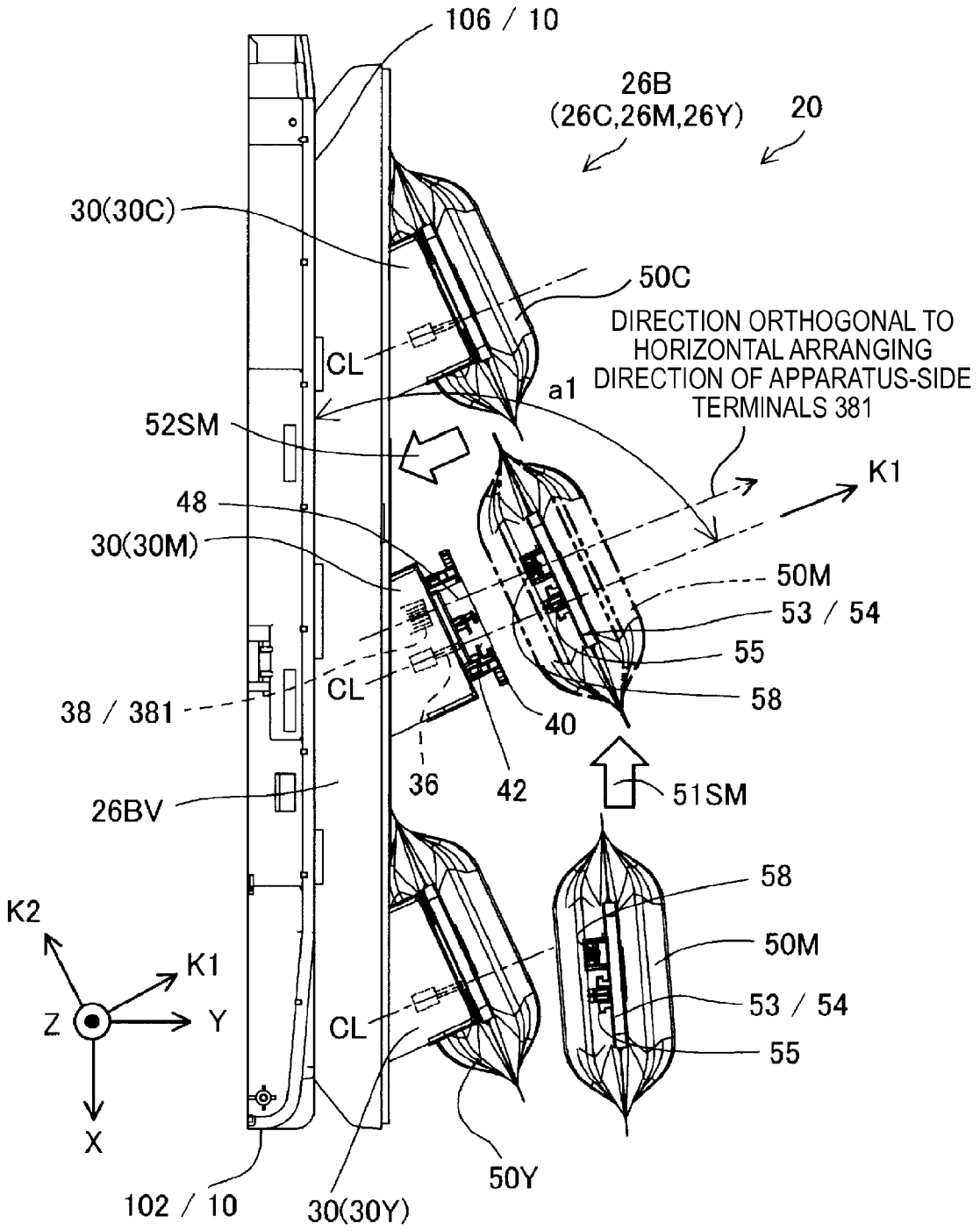
FIG. 22 is a first illustrative view showing an initial state of an operation of attaching the liquid containing body 50 as viewed from vertically above the printer 10.
Figure 23:
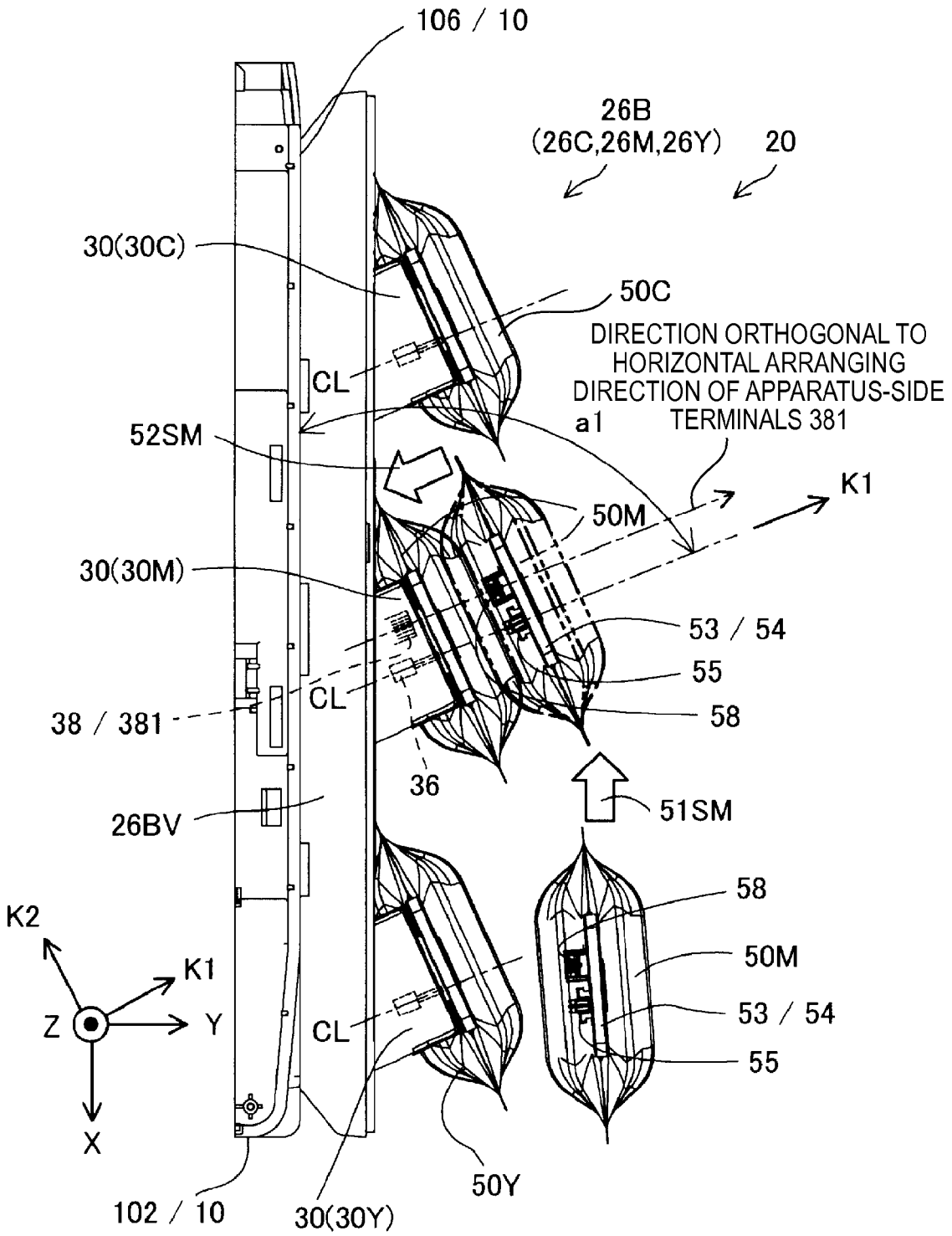
FIG. 23 is a second illustrative view showing a latter state of the operation of attaching the liquid containing body 50 as viewed from vertically above the printer 10.
Figure 24:
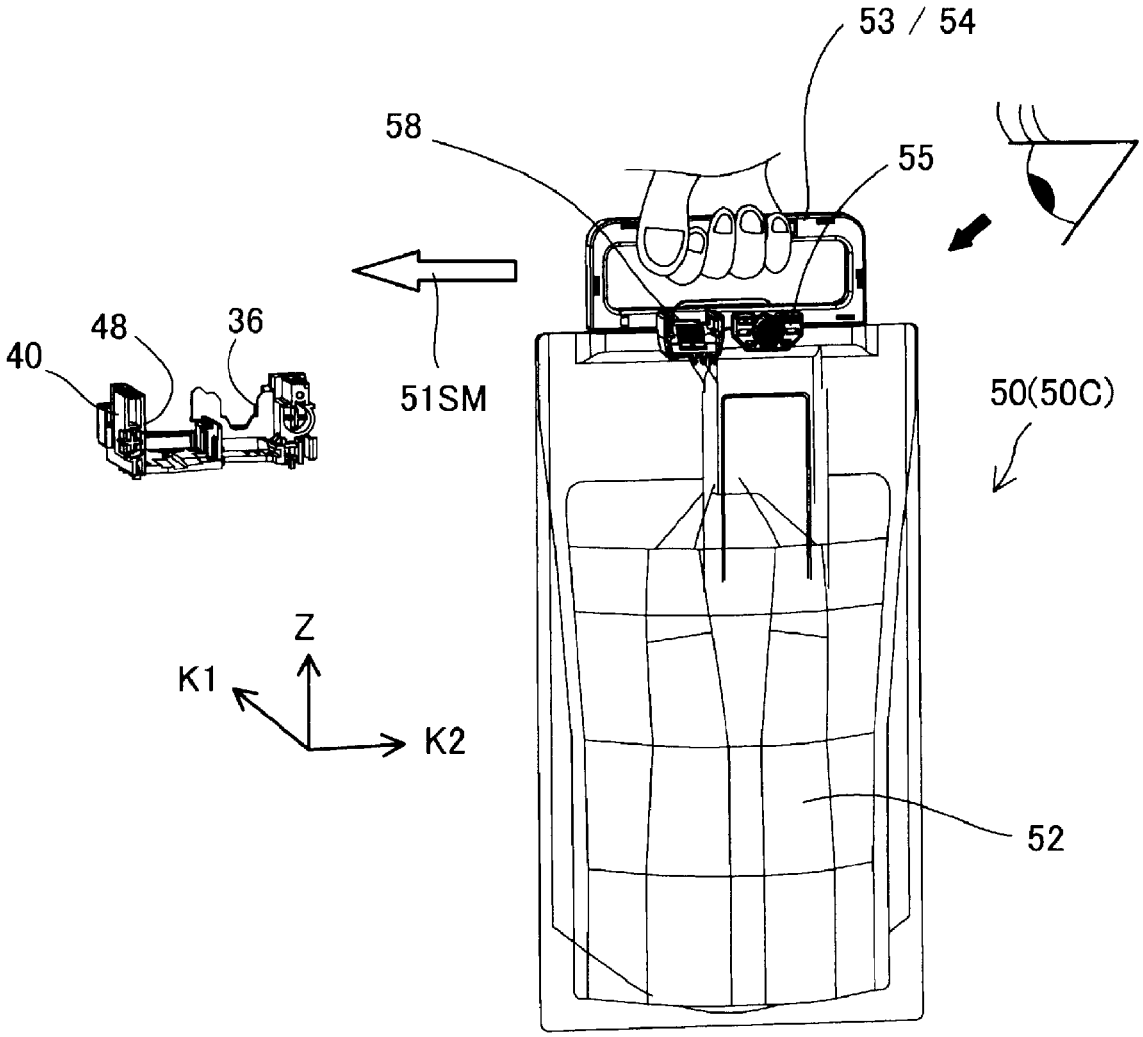
FIG. 24 is a third illustrative view showing the initial state of the operation of attaching the liquid containing body 50 as viewed in a −K1-axis direction.
Figure 25:
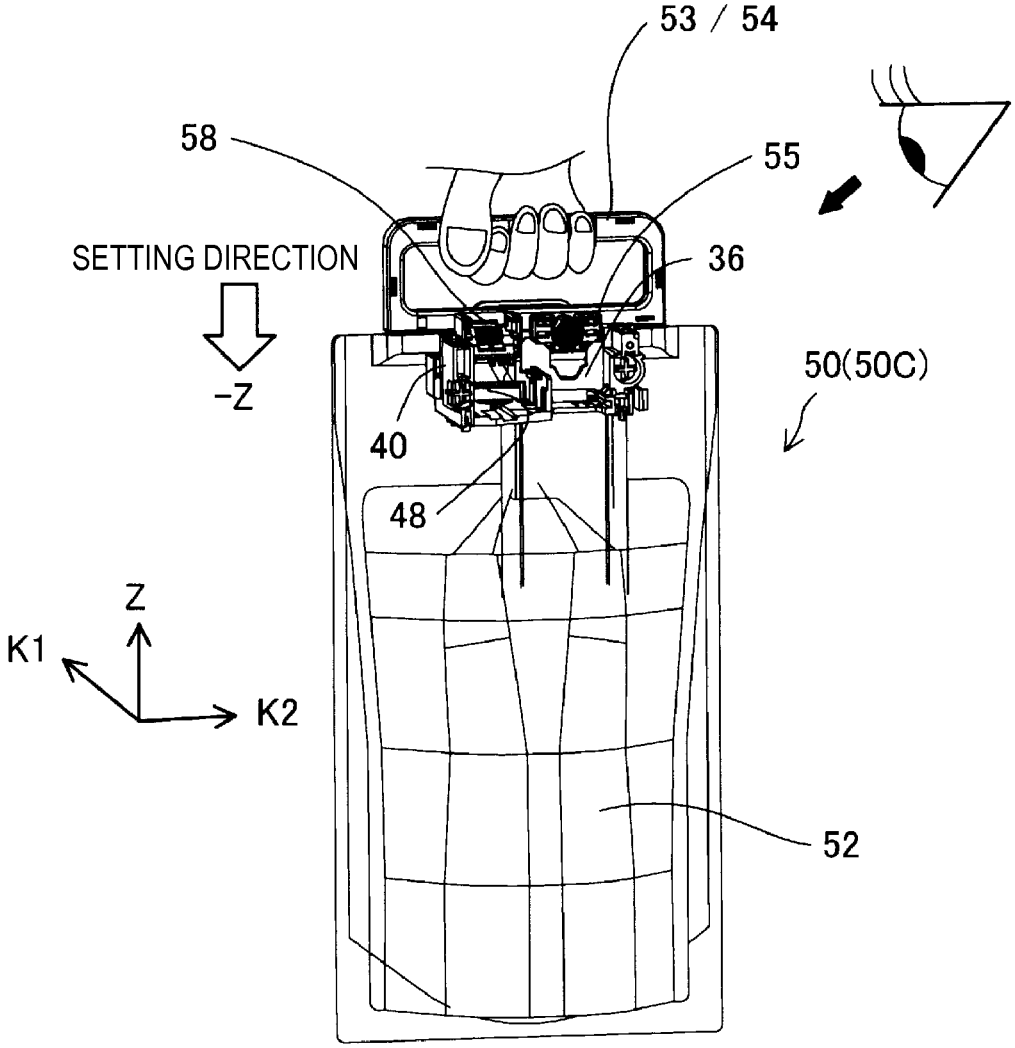
FIG. 25 is a fourth illustrative view showing a state of an operation in a setting direction in FIG. 19 in the operation of attaching the liquid containing body 50 as viewed in the −K1-axis direction.
Figure 26:
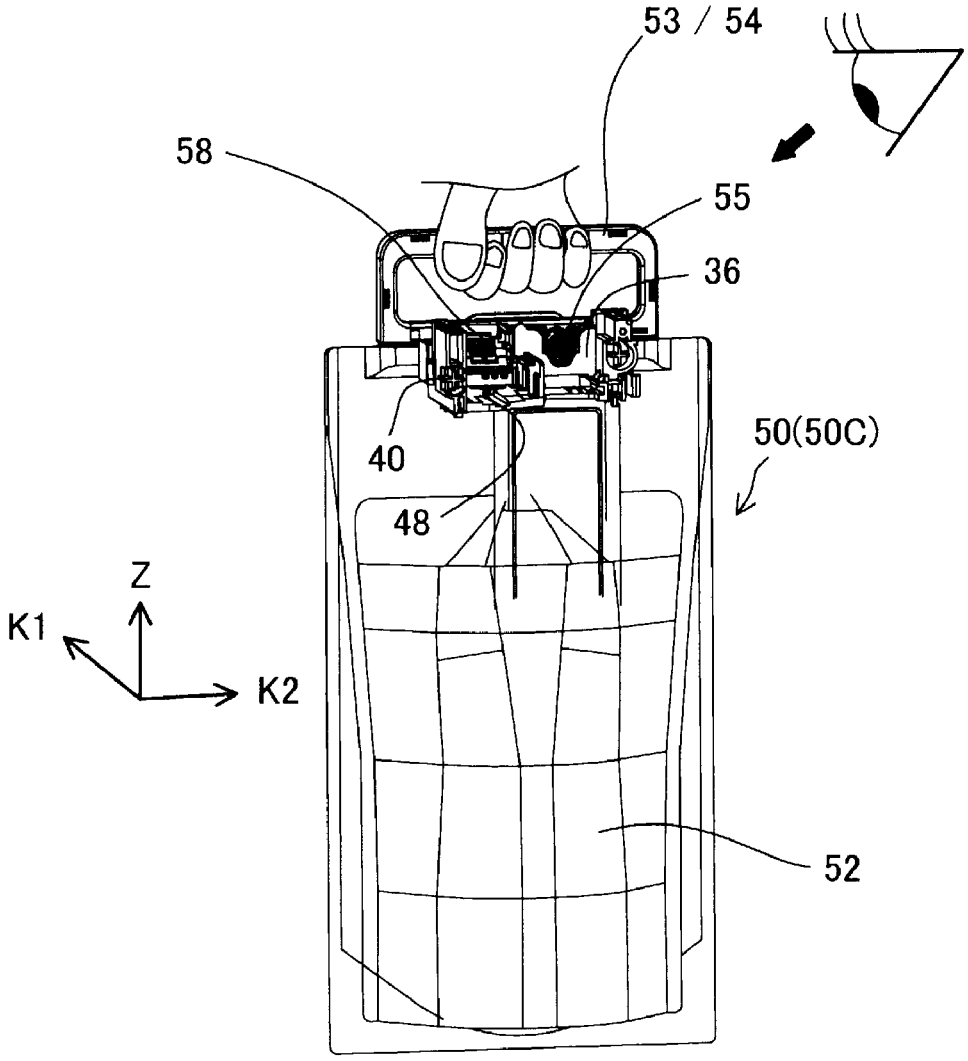
FIG. 26 is a fifth illustrative view showing a complete state of the operation in the setting direction in FIG. 19 in the operation of attaching the liquid containing body 50 as viewed in the −K1-axis direction.

Next, a state of attaching the liquid containing body 50 to the attachment/detachment unit 30 as viewed from another direction will be described. FIG. 22 is a first illustrative view showing an initial state of an operation of attaching the liquid containing body 50 as viewed from vertically above the printer 10. FIG. 23 is a second illustrative view showing a latter state of the operation of attaching the liquid containing body 50 as viewed from vertically above the printer 10. FIG. 24 is a third illustrative view showing the initial state of the operation of attaching the liquid containing body 50 as viewed in the −K1-axis direction. FIG. 25 is a fourth illustrative view showing a state of an operation in a setting direction in FIG. 19 in the operation of attaching the liquid containing body 50 as viewed in the −K1-axis direction. FIG. 26 is a fifth illustrative view showing a complete state of the operation in the setting direction in FIG. 19 in the operation of attaching the liquid containing body 50 as viewed in the −K1-axis direction.

FIGS. 22 and 23 show, in the embodiment in which the printer 10 has, on the right side wall 106, the attachment/detachment units 30 for the respective colors, namely cyan, magenta, and yellow, a state of newly attaching the liquid containing body 50M to the attachment/detachment unit 30M at the center as viewed from vertically above the printer 10. As shown in the drawings, before attaching the liquid containing body 50M, the liquid containing body 50Y and the liquid containing body 50C are already attached respectively to the attachment/detachment unit 30Y located further on the side of the apparatus first face 102 (apparatus front face 102) and the attachment/detachment unit 30C further on the side separate from the apparatus front face 102 than the attachment/detachment unit 30M that is to be attached. In this state, the user holds the holding portion 54 (see FIGS. 7 and 8) of the operation member 53 located further on the upper end side than the liquid containing portion 52 in the new liquid containing body 50M. Next, the user moves the liquid containing body 50M from the side of the apparatus front face 102 to the side of the attachment/detachment unit 30M while holding the holding portion 54, and causes the operation member 53 to face the attachment/detachment unit 30M. A first moving operation 51SM by far is an operation along a roughly linear trajectory as shown in FIGS. 22 to 24.

As shown in FIGS. 22 and 23, in addition to the attachment/detachment unit 30M, the attachment/detachment unit 30C and the attachment/detachment unit 30Y are also located on the side of the right side wall 106. The K1 axis along which the center axis CT of the liquid introduction portion 362 (see FIGS. 5 and 6) of the liquid introduction mechanism 36 of each unit extends forms the angle a1 in the clockwise direction with respect to the right side wall 106 when the printer 10 is viewed from vertically above, and this angle a1 in this embodiment is 68 degrees, which is larger than 0 degree and smaller than 90 degrees. For this reason, the liquid containing body 50C that is already attached to the attachment/detachment unit 30C and the liquid containing body 50Y that is already attached to the attachment/detachment unit 30Y are orthogonal to the K1 axis that inclines with respect to the right side wall 106 as mentioned above, and take an inclined posture with which peripheral ends on the side separate from the apparatus front face 102 are close to the right side wall 106, and peripheral ends on the side of the apparatus first face 102 are separated from the right side wall 106.

The attachment/detachment unit 30Y on the side of the apparatus front face 102 and the liquid containing body 50Y that is already attached thereto take the above-described inclined posture, and accordingly do not at all interfere with the trajectory of the aforementioned first moving operation 51SM. The attachment/detachment unit 30C separate from the side of the apparatus front face 102 and the liquid containing body 50C that is already attached thereto also take the above-described inclined posture, and accordingly do not interfere with the liquid containing body 50M that faces the attachment/detachment unit 30M when the first moving operation 51SM is completed. The liquid containing body 50M that is to be attached to the attachment/detachment unit 30M and held by the user takes the above-described inclined posture, and therefore moves along the trajectory of the first moving operation 51SM in a state where the liquid supply unit 55 and the board unit 58 of the liquid containing body 50M are oriented to the side of the apparatus front face 102. Accordingly, the user who performs the moving operation from the side of the apparatus front face 102 can view the liquid supply unit 55 and the board unit 58 of the held liquid containing body 50M while performing the first moving operation 51SM.

After causing the operation member 53 to face the attachment/detachment unit 30M, the user performs a second moving operation 52SM of bringing the operation member 53 close to the movable member 40 of the attachment/detachment unit 30M that is in the first state in FIG. 5, while keeping the posture of holding the holding portion 54. This second moving operation 52SM ends as a result of connection of the liquid supply unit 55 and the board unit 58 to the liquid introduction mechanism 36 and the board support portion 48 of the movable member 40 being enabled as shown in FIG. 25. During this second moving operation 52SM as well, the liquid supply unit 55 and the board unit 58 are oriented to the side of the apparatus first face 102 by the aforementioned inclined posture in the liquid containing body 50M, allowing the user to view. Then, the user also views the supply portion support portion 42 and the board support portion 48 of the movable member 40 in the attachment/detachment unit 30M while performing the second moving operation 52SM.

After completing this second moving operation 52SM, the user moves (setting movement) the liquid containing body 50M together with the operation member 53 in the setting direction shown in FIGS. 19 and 25 while keeping the posture of holding the holding portion 54. As a result of this setting movement, a state is achieved where the liquid supply unit 55 and the board unit 58 can be connected to the liquid introduction mechanism 36 and the board support portion 48 of the movable member 40. The user views the liquid supply unit 55 and the board unit 58 of the liquid containing body 50M and the supply portion support portion 42 and the board support portion 48 of the movable member 40 while performing this setting movement as well. Thereafter, the user presses the press portion 545 such that the liquid containing body 50 moves together with the movable member 40 in a connecting direction shown in FIG. 19, in order to achieve connection between the liquid introduction portion 362 on the side of the attachment/detachment unit 30M and the liquid supply portion 57 on the side of the liquid containing body 50M, and connection between the contact point mechanism 38 on the side of the attachment/detachment unit 30M and the circuit board 582 on the side of the liquid containing body 50M. As a result of this pressing, the liquid supply portion 57 and the circuit board 582 on the side of the liquid containing body 50M are simultaneously connected to the liquid introduction portion 362 and the contact point mechanism 38 on the side of the attachment/detachment unit 30M, and the movable member 40 also moves in the −K1-axis direction and is locked. Replacement of the liquid containing body 50M thereby ends.

A-5. Effects

The liquid consuming system 1000 in this embodiment that has the above-described configuration has the liquid supply apparatus 20 for the ink of the respective colors, namely cyan, magenta, and yellow, on the right side wall 106 when the printer 10 (see FIG. 1) is viewed from vertically above. The liquid supply apparatus 20 in this embodiment has the attachment/detachment unit 30C, the attachment/detachment unit 30M, and the attachment/detachment unit 30Y for the ink of the respective colors in an inclined manner such that the K1 axis (the center axis CL) along which the liquid introduction portion 362 of each unit extends for liquid introduction forms the angle a1 of 68 degrees, which is larger than 0 degree and smaller than 90 degrees, in the clockwise direction with respect to the right side wall 106 (see FIGS. 22 and 23). With this liquid supply apparatus 20 in this embodiment, for example, in order to attach a new liquid containing body 50M to the attachment/detachment unit 30M sandwiched between the attachment/detachment unit 30C and the attachment/detachment unit 30Y on the right side wall 106, it is necessary to perform the first moving operation 51SM, which is along a roughly linear trajectory, of moving the liquid containing body 50M from the side of the apparatus front face 102 to the side of the attachment/detachment unit 30M while holding the holding portion 54 and causing the operation member 53 to face the attachment/detachment unit 30M, the second moving operation 52SM, which is along a roughly linear trajectory, of bringing the operation member 53 close to the movable member 40 of the attachment/detachment unit 30M, a setting movement operation of setting the operation member 53 into the movable member 40, and a locking operation of pressing and locking the movable member 40 to which the operation member 53 is already set.

Among the above operations, both the first moving operation 51SM and the second moving operation 52SM are operations performed along roughly linear trajectories until the liquid containing body 50 is connected to the attachment/detachment unit 30M, and an operation with a trajectory that detours the liquid containing body 50Y that is already attached to the attachment/detachment unit 30Y on the side of the apparatus front face 102 is not necessary. Accordingly, with the liquid supply apparatus 20 in this embodiment, the user can execute the first moving operation 51SM and the second moving operation 52SM as a series of operations without changing the holding posture of holding the operation member 53, and accordingly the operation of attaching the liquid containing body 50M is facilitated. Furthermore, the space of the housing space portion 26 for the operation of connecting the liquid containing body 50 can also be reduced.

The liquid supply apparatus 20 in this embodiment has the attachment/detachment units 30 for the ink of the aforementioned respective colors in an inclined manner with respect to the right side wall 106 as already described. Therefore, the liquid containing body 50C that is already attached to the attachment/detachment unit 30C and the liquid containing body 50Y that is already attached to the attachment/detachment unit 30Y are caused to be orthogonal to the K1 axis that inclines with respect to the right side wall 106 and take an inclined posture with which peripheral ends on the side separate from the apparatus front face 102 are close to the right side wall 106 and peripheral ends on the side of the apparatus front face 102 are separate from the right side wall 106. With this configuration, the liquid supply apparatus 20 in this embodiment does not at all cause the attachment/detachment unit 30Y on the side of the apparatus front face 102 and the liquid containing body 50Y that is already attached thereto to interfere with the trajectory of the aforementioned first moving operation 51SM for attaching the liquid containing body 50M. The attachment/detachment unit 30C separate from the side of the apparatus front face 102 and the liquid containing body 50C that is already attached thereto also take the above-described inclined posture, and accordingly do not interfere with the liquid containing body 50M that faces the attachment/detachment unit 30M when the first moving operation 51SM is completed. For this reason as well, with the liquid supply apparatus 20 in this embodiment, the first moving operation 51SM and the second moving operation 52SM that are along roughly linear trajectories need only be performed without considering interference with other liquid containing bodies 50, and therefore the attaching operation can be made convenient.

Since the liquid supply apparatus 20 in this embodiment has the attachment/detachment units 30 for the ink of the respective colors in an inclined manner with respect to the right side wall 106 as described above, the liquid supply unit 55 and the board unit 58 of the liquid containing body 50 to be attached and held by the user, e.g., the liquid containing body 50M are set to a state of being oriented to the side of the apparatus front face 102. Accordingly, with the liquid supply apparatus 20 in this embodiment, the user on the side of the apparatus front face 102 is caused to view the liquid supply unit 55 and the board unit 58 of the held liquid containing body 50M while performing the first moving operation 51SM, the second moving operation 52SM, and the following setting operation described above. Accordingly, each of the above operations is more reliable and easy.

The aforementioned ease of the operations is achieved not only when attaching the liquid containing body 50M but also when attaching the liquid containing body 50Y to the attachment/detachment unit 30Y on the side of the apparatus front face 102 and when attaching the liquid containing body 50C to the attachment/detachment unit 30C on the side separate from the apparatus front face 102.

In the liquid supply apparatus 20 in this embodiment, the liquid containing body 50 is supported using the fixed member 35 of the attachment/detachment unit 30 without using a casing, and at the time of the supporting, a part of the liquid containing body 50 is supported, rather than the entire liquid containing body 50. More specifically, the liquid containing body 50 is supported at the upper end thereof. Accordingly, with the liquid supply apparatuses 20 in this embodiment, the structure for supporting the liquid containing body 50 can be simplified as compared with a configuration in which the liquid containing portion is supported using a casing. It is possible, through this simplification of the configuration, to reduce the number of parts, and also suppress an increase in the size and complication of the system.

In addition, the following advantages can be achieved with the liquid supply apparatus 20 in this embodiment. The liquid supply apparatus 20 in this embodiment integrally includes the positioning portion 56 and the containing body-side electric connection portion 58 in the operation member 53. Accordingly, with the liquid supply apparatus 20 in this embodiment, the liquid containing body 50 can be operated while holding the operation member 53 when connecting the liquid containing body 50 to the printer 10. Therefore, the operability is better than a liquid containing body that does not have the operation member 53. Moreover, it is possible to simultaneously achieve insertion of the liquid introduction portion 362 of the attachment/detachment unit 30 into the liquid supply portion 57 of the liquid containing body 50 and electric connection between the terminals of the circuit board 582 of the liquid containing body 50 and the electric connection portion 382 of the contact point mechanism 38 in the attachment/detachment unit 30, which is convenient.

B. Second Embodiment

B-1. Configuration and Effects of Liquid Supply Apparatus

Figure 27:
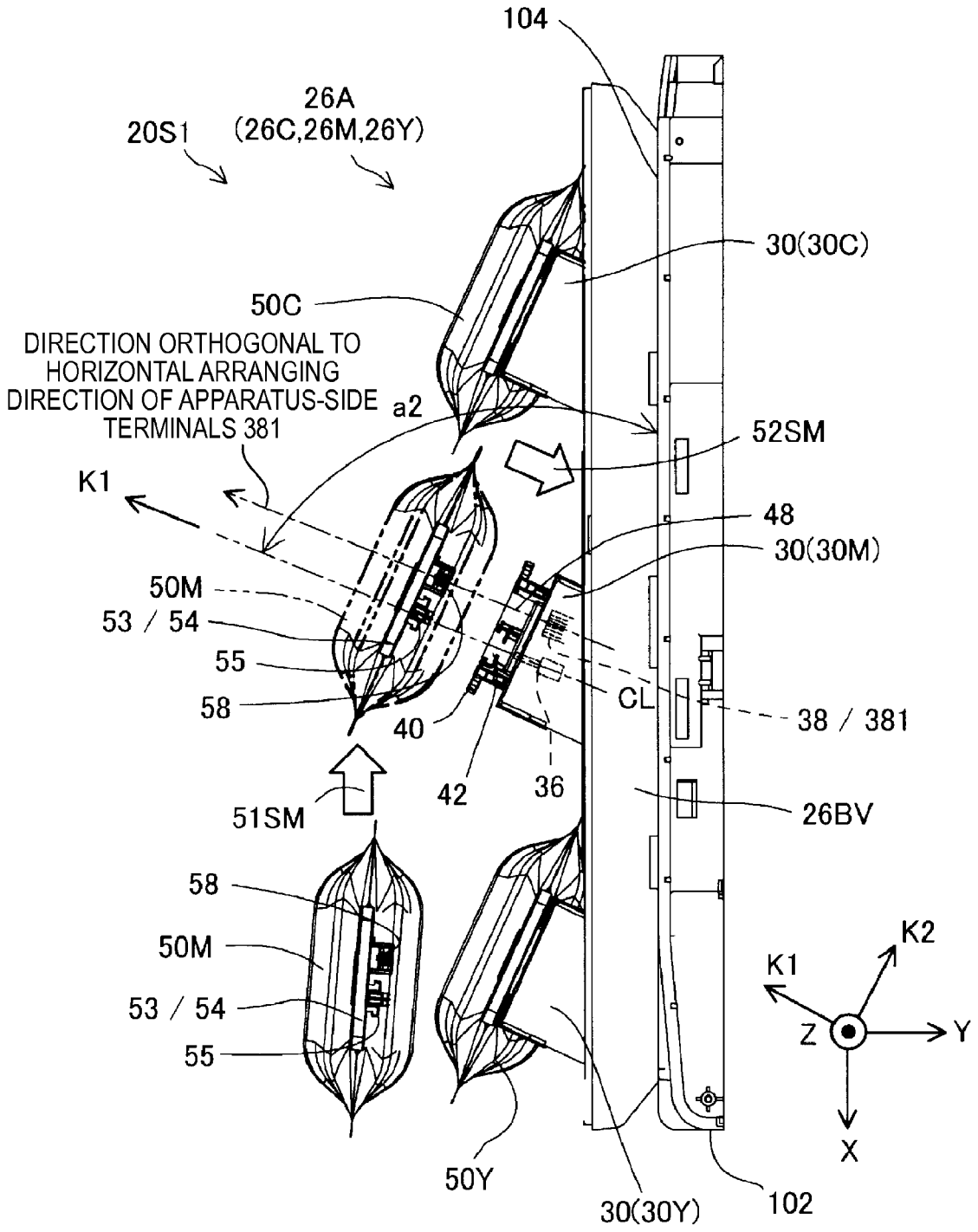
FIG. 27 is an illustrative view showing a liquid supply apparatus 20S1 in a second embodiment as viewed from vertically above the printer 10.

FIG. 27 is an illustrative view showing a liquid supply apparatus 2051 in a second embodiment as viewed from vertically above the printer 10. In the following description, the same members as those in the already-described liquid supply apparatus 20 will be given the same reference numerals, and a detailed description thereof will be omitted.

As shown in FIG. 27, the liquid supply apparatus 2051 in this embodiment has liquid containing bodies 50 for ink of respective colors, namely cyan, magenta, and yellow, which are attached to attachment/detachment units 30 in a housing space portion 26 on a left side wall 104 when the printer 10 (see FIG. 1) is viewed from vertically above. The liquid supply apparatus 2051 in this embodiment has an attachment/detachment unit 30C, an attachment/detachment unit 30M, and an attachment/detachment unit 30Y for the ink of the respective colors in an inclined manner such that a K1 axis (the center axis CL) along which a liquid introduction portion 362 of each unit extends for liquid introduction forms an angle a2 of 68 degrees, which is larger than 0 degree and smaller than 90 degrees, in the counterclockwise direction with respect to the left side wall 104. With the liquid supply apparatus 20S1 in this embodiment as well, the operation of attaching the liquid containing bodies 50 can be easily performed, as with the already-described liquid supply apparatus 20.

C. Modifications

Note that the invention is not limited to the above examples and embodiments, and may be implemented in various modes without departing from the gist of the invention. For example, the following modifications are possible.

C-1. First Modification

In the above-described embodiments, the overall region of each liquid containing portion 52 is formed by a flexible member. However, the invention is not limited thereto, and the liquid containing portion 52 need only be able to function as a liquid containing portion capable of containing liquid inside. For example, the liquid containing portion 52 may be partially formed by a flexible member, or may be formed by a rigid member whose volume does not change regardless of the amount of consumed liquid.

C-2. Second Modification

In the above embodiments, the operation member 53 has a frame shape (FIG. 13). However, the shape thereof is not limited thereto, and may be a shape that can be held by the user. For example, the operation member 53 may be a bar shape (plate shape) extending in the Z-axis direction.

C-3. Third Modification

The invention is applicable not only to an inkjet printer and a liquid containing body 50 thereof, but also to any printer (liquid consuming apparatus) that ejects liquid other than ink, and a liquid containing body for containing this liquid. For example, the invention is applicable to various liquid consuming apparatuses as listed below and liquid containing bodies thereof.

(1) Image recording apparatuses such as a facsimile apparatus (2) Color material ejection apparatuses used to manufacture color filters for image display apparatuses such as a liquid crystal display (3) Electrode material ejection apparatuses used to form electrodes for organic EL (Electro Luminescence) displays, field emission displays (FED), and the like (4) Liquid consuming apparatuses that eject liquid containing biological organic matter used to manufacture biochips (5) Sample ejection apparatuses serving as precision pipettes (6) Lubricating oil ejection apparatuses (7) Resin solution ejection apparatuses (8) Liquid consuming apparatuses that perform pinpoint ejection of lubricating oil to precision machines such as a watch and a camera (9) Liquid consuming apparatuses that eject transparent resin solution such as UV-cured resin solution onto substrates in order to form micro-hemisphere lenses (optical lenses) used in optical communication elements and the like

(10) Liquid consuming apparatuses that eject acid or alkaline etchant in order to etch substrates and the like

(11) Liquid consuming apparatuses including liquid ejection heads for discharging a very small amount of any other kinds of droplet Note that the "droplet" refers to a state of the liquid discharged from a liquid consuming apparatus, and includes droplets having a granular shape, a tear-drop shape, and a shape having a thread-like trailing end. Furthermore, the "liquid" mentioned here need only be any kind of material that can be ejected by a liquid consuming apparatus. For example, the "liquid" need only be a material in a state where a substance is in a liquid phase, and a liquid material having a high or low viscosity, sol, gel water, and other liquid materials such as inorganic solvent, organic solvent, solution, liquid resin, and liquid metal (metallic melt) are also included in the "liquid". Furthermore, the "liquid" is not limited to being a one-state substance, and also includes particles of a functional material made from solid matter, such as pigment or metal particles, that are dissolved, dispersed, or mixed in a solvent, and the like. Representative examples of the liquid include ink such as that described in the above embodiments, liquid crystal, and the like. Here, the "ink" encompasses general water-based ink and oil-based ink, as well as various types of liquid compositions such as gel ink and hot melt-ink. When UV ink that can be cured by radiating ultraviolet thereto is contained in this liquid containing body and connected to a printer, the liquid containing portion is separate from the installation surface, and accordingly it is less likely that heat on the installation surface is transmitted to the liquid containing portion and cures the UV ink.

C-4. Fourth Modification

In the above embodiments, the attachment/detachment units 30 to which the liquid containing bodies 50 for the ink of the respective colors, namely cyan, magenta, and yellow are attached are caused to take an inclined posture as described above. However, the independent attachment/detachment unit 30K to which the liquid containing body 50K for black ink is attached can also be caused to take an inclined posture. That is to say, in the case of a configuration in which the attachment/detachment unit 30K is provided on the side of the left side wall 104, the attachment/detachment unit 30K need only be inclined clockwise with respect to the left side wall 104 as described above. In the case of a configuration in which the attachment/detachment unit 30K is provided on the side of the right side wall 106, the attachment/detachment unit 30K need only be inclined counterclockwise with respect to the right side wall 106 as described above.

C-5. Fifth Modification

In the above embodiments, in a front view of each attachment/detachment unit 30 in the K1-axis direction, the liquid introduction mechanism 36 and the contact point mechanism 38 are provided side-by-side such that the liquid introduction mechanism 36 is located on the left side of the unit and the contact point mechanism 38 is located on the right side of the unit (see FIGS. 5 and 6). However, the liquid introduction mechanism 36 may be located on the right side of the unit, and the contact point mechanism 38 may be located on the left side of the unit. In this case, the liquid supply unit 55 and the board unit 58 in the liquid containing body 50 need only be arranged in a reverse manner of the arrangement shown in FIG. 13.

C-6. Sixth Modification

Figure 28:
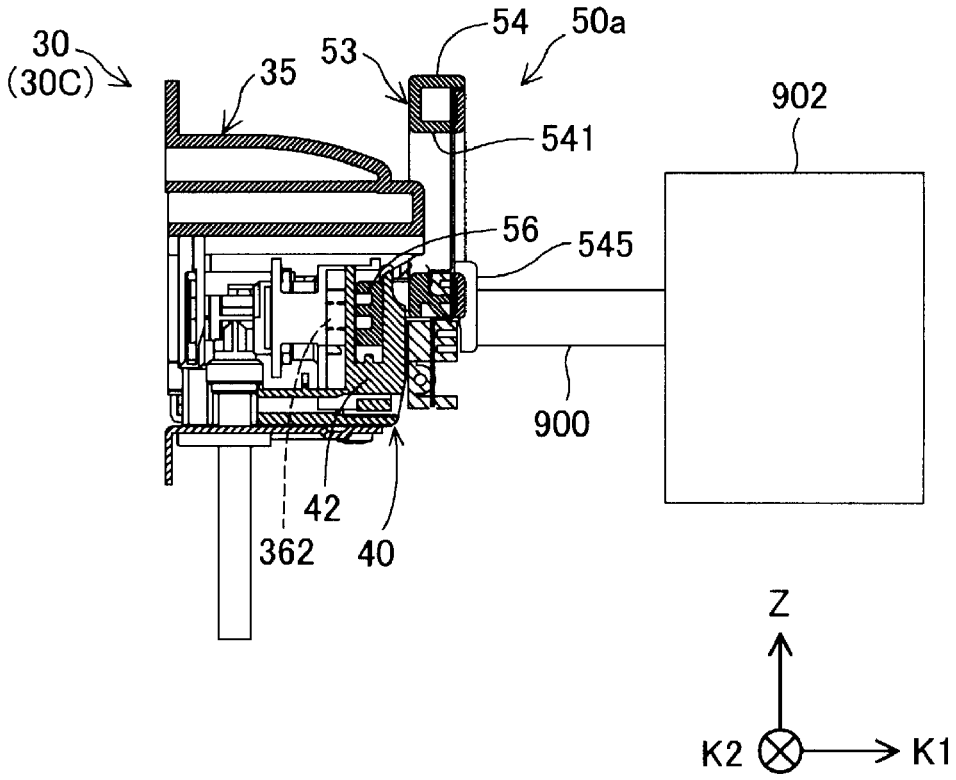
FIG. 28 is a diagram for illustrating an electric connection body 50*a*.

FIG. 28 is a diagram for illustrating an electric connection body 50*a*. In the above embodiments, each liquid containing body 50 includes the liquid containing portion 52 and the liquid supply portion 57 (see FIGS. 7 and 9). However, these may be omitted and the electric connection body 50*a* may be provided. That is to say, the electric connection body 50*a* is a configuration that omits the liquid containing portion 52 and the liquid supply portion 57 in the liquid containing body 50. The other configuration is similar to that of the liquid containing body 50. When using this electric connection body 50*a*, ink is supplied to the printer 10 from a tank (liquid reservoir source) 902 arranged outside for containing the ink, via a liquid flow tube (hose) 900 through which the tank 902 and the liquid introduction portion 362 are in communication with each other. With this configuration as well, the same effects as those of the above embodiments can be achieved. For example, when connecting the electric connection body 50*a* to the printer 10, the electric connection body 50*a* can be easily connected to the attachment/detachment unit 30 caused to take the already-described inclined posture through the already-described first moving operation 51SM and second moving operation 52SM while holding the operation member 53. Accordingly, the operability is better than in the case where the operation member 53 is not provided. Note that the liquid flow tube (hose) 900 may be connected to the middle of a liquid flow tube that is connected to the liquid consuming apparatus, which is the printer 10, from the liquid introduction portion 362.

C-7. Seventh Modification

In the above embodiments, the containing body-side electric connection portion 58 includes the circuit board 582. However, the invention is not limited thereto, and the containing body-side electric connection portion 58 need only have the contact portion cp that can come into contact with the apparatus-side electric connection portion 382. For example, the circuit board 582 may not include the storage device 583. For example, the containing body-side electric connection portion 58 may include a contact portion of a terminal that is used to detect attachment and detachment of the liquid containing body 50. Furthermore, the containing body-side electric connection portion 58 may include a general circuit board including a flexible cable, such as a flexible print board (FPC). This circuit board has, on one end side, a contact portion that can come into contact with the apparatus-side electric connection portion 382. The other end side is connected to a reset apparatus, for example. The above modification may be employed in place of the circuit board 582, or may be employed together with the circuit board 582.

The invention is not limited to the above embodiments, examples, and modifications, and can be achieved in various configurations without departing from the gist of the invention. For example, the technical features in the embodiments, examples, and modifications corresponding to the technical features in the modes described in the summary of the invention can be replaced or combined as appropriate in order to solve a part of or the entire problem described above, or in order to achieve some or all of the aforementioned effects. A technical feature that is not described as essential in the specification can be deleted as appropriate.

What is claimed is:

1. A liquid containing body adapted to be connected to a liquid consuming apparatus having a liquid introduction portion and a front face and when viewed from the perspective of facing the front face, a right side wall constituting a first side face with respect to the front face, and a left side wall constituting a second side face with respect to the front face, and when the liquid consuming apparatus has the liquid introduction portion connected on the right side wall, the liquid introduction portion extends in a right side liquid introduction portion direction at an angle a1 that is larger than 0 degrees and smaller than 90 degrees, in a plan view of the liquid consuming apparatus as viewed from vertically above, in a clockwise direction with respect to the right side wall, and when the liquid consuming apparatus has the liquid introduction portion connected on the left side wall, the liquid introduction portion extends in a left side liquid introduction portion direction at an angle a2 that is larger than 0degrees and smaller than 90 degrees, in a plan view, in a counterclockwise direction with respect to the left side wall, and the liquid containing body comprising:

a liquid containing portion, at least a part of which is flexible;

an operation portion that is located at an upper part of the liquid containing body when the liquid containing body is connected to the liquid consuming apparatus, and the operation portion is adapted to be held; and a liquid supply portion connected to the operation portion, and adapted to be connected to the liquid introduction portion in the introduction portion extending direction, and to guide the liquid contained in the liquid containing portion from the liquid containing portion to the connected liquid introduction portion.

2. The liquid containing body according to claim 1, wherein the liquid consuming apparatus has an electric connection portion that is arranged side-by-side with the liquid introduction portion in a horizontal direction in a front view of the liquid introduction portion as viewed in the introduction portion extending direction, and the liquid containing body further comprises a contact portion adapted and arranged to come into contact with the electric connection portion, the contact portion being arranged in the operation portion side-by-side with the liquid supply portion in association with arrangement of the liquid introduction portion and the electric connection portion.

3. An electric connection body having a contact portion capable of coming into contact with an electric connection portion of a liquid consuming apparatus, the electric connection portion of the liquid consuming apparatus having a plurality of apparatus-side terminals adapted to come into contact with the contact portion of the electric connection body, arranged side-by-side in a horizontal direction, the liquid consuming apparatus having a front face and a right side wall constituting a first side face with respect to the front face, and a left side wall constituting a second side face with respect to the front face, and when the liquid consuming apparatus has the electric connection portion in contact on the right side wall and the apparatus-side terminals are arranged in a horizontal right side arranging direction, an angle al that is larger than 0 degrees and smaller than 90 degrees is formed, in a plan view of the liquid consuming apparatus as viewed from vertically above, in a clockwise direction with respect to the right side wall, by a direction orthogonal to the horizontal right side arranging direction of the apparatus-side terminals, and when the liquid consuming apparatus has the electric connection portion in contact on the left side wall, and the apparatus-side terminals are arranged in a horizontal left side arranging direction an angle a2 that is larger than 0 degrees and smaller than 90 degrees is formed, in the plan view, in a counterclockwise direction with respect to the left side wall by a direction orthogonal to the horizontal left side arranging direction of the apparatus-side terminals, and the electric connection body comprising:

an operation portion that is adapted to be held when the electric connection body is connected to the liquid consuming apparatus; and a plurality of the contact portions that are provided in the operation portion are adapted and arranged to come into contact with the apparatus-side terminals of the electric connection portion.

4. A combination of a liquid container system and a connection portion of a liquid consuming apparatus having a front face and when viewed from the perspective of facing the front face, a right side face and a left side face, the combination comprising:

a connection portion having a right side liquid introduction portion located on the right side of the front face, extending in a right side liquid introduction direction at an inclined angle to an axis orthogonal to the front face and a left side liquid introduction portion on the left side of the front face, extending in a left side liquid introduction direction at an inclined angle to an axis orthogonal to the front face, the left side and right side liquid introduction portions adapted to receive liquid;

a right side liquid containing body having a right side liquid containing portion, at least a part of which is flexible, and a right side operation portion connected with the right side liquid containing portion, the right side operation portion having a right side liquid supply portion detachably connected to the right side liquid introduction portion and adapted to supply liquid from the right side liquid containing portion to the right side liquid introduction portion; and a left side liquid containing body having a left side liquid containing portion, at least a part of which is flexible, and a left side operation portion connected with the left side liquid containing portion, the left side operation portion having a left side liquid supply portion detachably connected to the left side liquid introduction portion and adapted to supply liquid from the left side liquid containing portion to the left side liquid introduction portion.

5. The combination of claim 4, wherein an electric connection portion is side-by-side the left side and the right side liquid introduction portions and the left side and the right side operation portions each have contact portions next to the respective left side and right side liquid supply portions, the contact portions adapted and arranged to be in electrical contact with the respective connection portions at the left side and the right side liquid introduction portions.

6. The combination of claim 5, wherein one of the left side or the right side liquid containing portions contains black ink and the other contains colored ink.

7. The combination of claim 4, wherein the left side and right side operation portion includes a handle, extending in a direction opposite to the direction of the left side and right side liquid containing portion and the handle is adapted and positioned to be grasped when the left side and right side liquid containing body is connected to the connection portion.

8. The combination of claim 4, wherein the left side and the right side liquid containing bodies are oriented with the operation portion above the liquid containing body and the left side and the right side liquid introduction directions are horizontal and at an inclined angle to the respective left and right sides.

* * * * *